US010458725B2

(12) United States Patent
Vanderwees et al.

(10) Patent No.: US 10,458,725 B2
(45) Date of Patent: Oct. 29, 2019

(54) HEAT EXCHANGER WITH JOINTED FRAME

(71) Applicant: Dana Canada Corporation, Oakville (CA)

(72) Inventors: Doug Vanderwees, Mississauga (CA); Nick Kalman, Hamilton (CA); Brian Cheadle, Brampton (CA)

(73) Assignee: Dana Canada Corporation, Oakville, ON (CA)

( * ) Notice: Subject to any disclaimer, the term of this patent is extended or adjusted under 35 U.S.C. 154(b) by 593 days.

(21) Appl. No.: 14/211,004

(22) Filed: Mar. 14, 2014

(65) Prior Publication Data

US 2014/0262175 A1 Sep. 18, 2014

Related U.S. Application Data

(60) Provisional application No. 61/793,865, filed on Mar. 15, 2013.

(51) Int. Cl.

| | |
|---|---|
| ***F28F 3/08*** | (2006.01) |
| ***F28F 3/10*** | (2006.01) |
| ***F28D 9/00*** | (2006.01) |

(52) U.S. Cl.

CPC ..... *F28F 3/083* (2013.01); *F28D 9/005* (2013.01); *F28F 3/10* (2013.01); *Y10T 29/4935* (2015.01)

(58) Field of Classification Search

CPC ..... F28D 9/0062; F28D 9/0075; F28F 3/08; F28F 3/083; F28F 3/10; F28F 2275/04; F28F 2280/04; F28F 3/00; F28F 3/086

(Continued)

(56) References Cited

U.S. PATENT DOCUMENTS 1,502,524 A 7/1924 Price, Jr.
1,986,465 A 1/1935 Dempsey (Continued)

FOREIGN PATENT DOCUMENTS

EP 0136481 A2 * 4/1985 ..... F28D 9/0075
EP 1526350 A2 4/2005

(Continued)

OTHER PUBLICATIONS

International Search Report with Written Opinion for PCT/CA2014/050247.

(Continued)

*Primary Examiner* — Christopher R Zerphey
*Assistant Examiner* — For K Ling
(74) *Attorney, Agent, or Firm* — Marshall & Melhorn, LLC

(57) ABSTRACT

A plate and frame style heat exchanger is disclosed herein the heat exchanger is formed by a plurality of heat exchange plates and frame members that are alternatingly stacked together to form fluid channel members. The frame members are formed by lengths of material that are formed or bent into the desired configuration for providing a first fluid tight seal around the periphery of the plates and a second fluid tight seal around respective fluid openings formed in the heat exchanger plates in order to achieve the desired flow configuration through the heat exchanger. In some embodiments the frame members are made up of two mating frame portions that join together in a self-aligning and self-fixturing relationship to facilitate assembly.

10 Claims, 19 Drawing Sheets

(58) Field of Classification Search
USPC ..... 165/165–167
See application file for complete search history.

(56) References Cited

U.S. PATENT DOCUMENTS

| | | | | | |
|---|---|---|---|---|---|
| 2,379,671 | A | * | 7/1945 | Wetherby-Williams | F28F 3/083 165/167 |
| 2,782,010 | A | * | 2/1957 | Simpelaar | F28D 9/0075 165/167 |
| 3,017,161 | A | * | 1/1962 | Slaasted | F28D 1/0375 165/166 |
| 3,042,382 | A | * | 7/1962 | Hryniszak | F28D 9/0075 165/167 |
| 3,175,832 | A | | 3/1965 | Carrell | |
| 3,245,693 | A | | 4/1966 | Way | |
| 3,334,399 | A | * | 8/1967 | Teeguarden | B21D 53/04 165/166 |
| 3,375,570 | A | * | 4/1968 | Dubusker | B23K 1/0012 165/166 |
| 3,583,711 | A | | 6/1971 | Engelman | |
| 3,738,670 | A | | 6/1973 | Jelinek et al. | |
| 4,380,856 | A | | 4/1983 | Wallace | |
| 4,403,652 | A | * | 9/1983 | Schiltz | F28D 9/0081 165/167 |
| 4,580,793 | A | | 4/1986 | Bronson | |
| 4,646,821 | A | * | 3/1987 | Almqvist | F28F 3/10 165/166 |
| 4,653,581 | A | * | 3/1987 | Yogo | F28D 9/0075 165/166 |
| 4,690,413 | A | | 9/1987 | Adkins | |
| 4,705,102 | A | * | 11/1987 | Kanda | F28D 15/0233 165/104.21 |
| 4,815,534 | A | * | 3/1989 | Fuerschbach | F28D 9/0075 165/166 |
| 4,893,673 | A | * | 1/1990 | Rosman | F28D 9/0075 165/166 |
| 5,020,809 | A | | 6/1991 | Mullaney | |
| 5,149,108 | A | | 9/1992 | Leiszter | |
| 5,149,109 | A | | 9/1992 | Jelinek et al. | |
| 5,161,808 | A | | 11/1992 | Walters | |
| 5,236,203 | A | | 8/1993 | Uchida et al. | |
| 5,618,047 | A | | 4/1997 | Better | |
| 6,076,832 | A | | 6/2000 | Pow | |
| 6,308,960 | B1 | | 10/2001 | Peale | |
| 6,516,874 | B2 | | 2/2003 | Mathur et al. | |
| 6,989,134 | B2 | | 1/2006 | Tonkovich et al. | |
| 7,011,482 | B2 | | 3/2006 | Underwood et al. | |
| 7,404,434 | B2 | | 7/2008 | Martin et al. | |
| 8,123,228 | B2 | | 2/2012 | Muldoon et al. | |
| 2003/0121649 | A1 | | 7/2003 | Seiler et al. | |
| 2004/0182541 | A1 | | 9/2004 | Blomgren | |
| 2005/0082049 | A1 | | 4/2005 | Brost | |
| 2006/0032621 | A1 | | 2/2006 | Martin et al. | |
| 2010/0044021 | A1 | | 2/2010 | Noel-Baron et al. | |

FOREIGN PATENT DOCUMENTS

| | | | | | |
|---|---|---|---|---|---|
| FR | 1345815 | A | * | 12/1963 | F58F 3/046 |
| FR | 2584806 | A1 | * | 1/1987 | F28F 3/083 |
| GB | 2219387 | A | | 12/1989 | |
| JP | H0979784 | A | | 3/1997 | |
| JP | 2006313030 | A | | 11/2006 | |
| JP | 2009052873 | A | | 3/2009 | |
| WO | 2006017925 | A1 | | 2/2006 | |

OTHER PUBLICATIONS

English Abstract of JP2006313030A.
English Language Abstract of JPH0979784(A).

* cited by examiner

HEAT EXCHANGER WITH JOINTED FRAME

TECHNICAL FIELD

The invention relates generally to heat exchangers, in particular heat exchangers comprising a stack of spaced apart flat plates.

BACKGROUND

Bar and plate or plate and frame heat exchangers are most commonly used in industry for prototype applications or for low volume production and high model mix applications. For these types of applications it is desirable to keep production and manufacturing costs to a minimum, especially while allowing for flexibility in design without corresponding re-investment in expensive tooling. Traditional bar and plate or plate and frame style heat exchangers allow design flexibility and typically require minimal tooling costs, which is desirable given their application. However, bar and plate or plate and frame style heat exchangers are often labour intensive to build/manufacture, and may require numerous bar or frame components that are relatively expensive in material cost, and that may be relatively complex to assemble.

There is a continual need to reduce costs associated with the design and manufacture of this type of plate-type heat exchangers as well as to reduce the labour intensity and assembly complexity often required for their manufacture.

Accordingly, there is an on-going need to maintain or increase flexibility in plate type heat exchanger designs, while reducing or avoiding tooling costs, reduce the overall number of components and associated material costs, and to provide simpler and more robust assembly methods.

SUMMARY OF THE PRESENT DISCLOSURE

In accordance with a first example embodiment of the present disclosure there is provided a heat exchanger comprising a plurality of stacked heat exchanger plates; a plurality of frame members interposed between each of said heat exchanger plates, the frame members spacing apart each of said plates, the frame members and plurality of stacked heat exchanger plates together defining fluid channels therebetween; corresponding pairs of openings formed in each of said heat exchanger plates, the corresponding pairs of openings in adjacent plates aligning so as to define respective inlet and outlet manifolds for the flow of a first and a second fluid through corresponding ones of said fluid channels in said heat exchanger; wherein each of the frame members comprises a first sealing member adapted to correspond to the periphery of at least a portion of the heat exchanger plates; a second sealing member adapted to form fluid boundaries around the corresponding pair of openings formed in the heat exchanger plates; at least two free ends forming at least one joint such that said frame member provides a first fluid tight seal around the entire periphery of the plates, and a second fluid tight seal around one of said corresponding pairs of openings formed in the plates.

In accordance with another example embodiment of the present disclosure there is provided a method of making a heat exchanger, comprising the steps of providing a plurality of heat exchange plates having fluid openings formed therein; providing a plurality of frame members, the frame members being formed from at least one length of material having two free ends; bending said at least one length of material into a configuration to provide a first sealing member following the periphery of the heat exchange plates, and a second sealing member forming a boundary around at least one of said fluid openings in said plates, each of said free ends forming at least part of a joint to form a sealing frame member; forming an alternating stack of said heat exchanger plates and said sealing frame members to form first and second sets of fluid channel members.

BRIEF DESCRIPTION OF THE DRAWINGS

Exemplary embodiments of the present disclosure will now be described by way of example with reference to the accompanying drawings, in which.

DETAILED DESCRIPTION OF EXEMPLARY EMBODIMENTS

Figure 1:
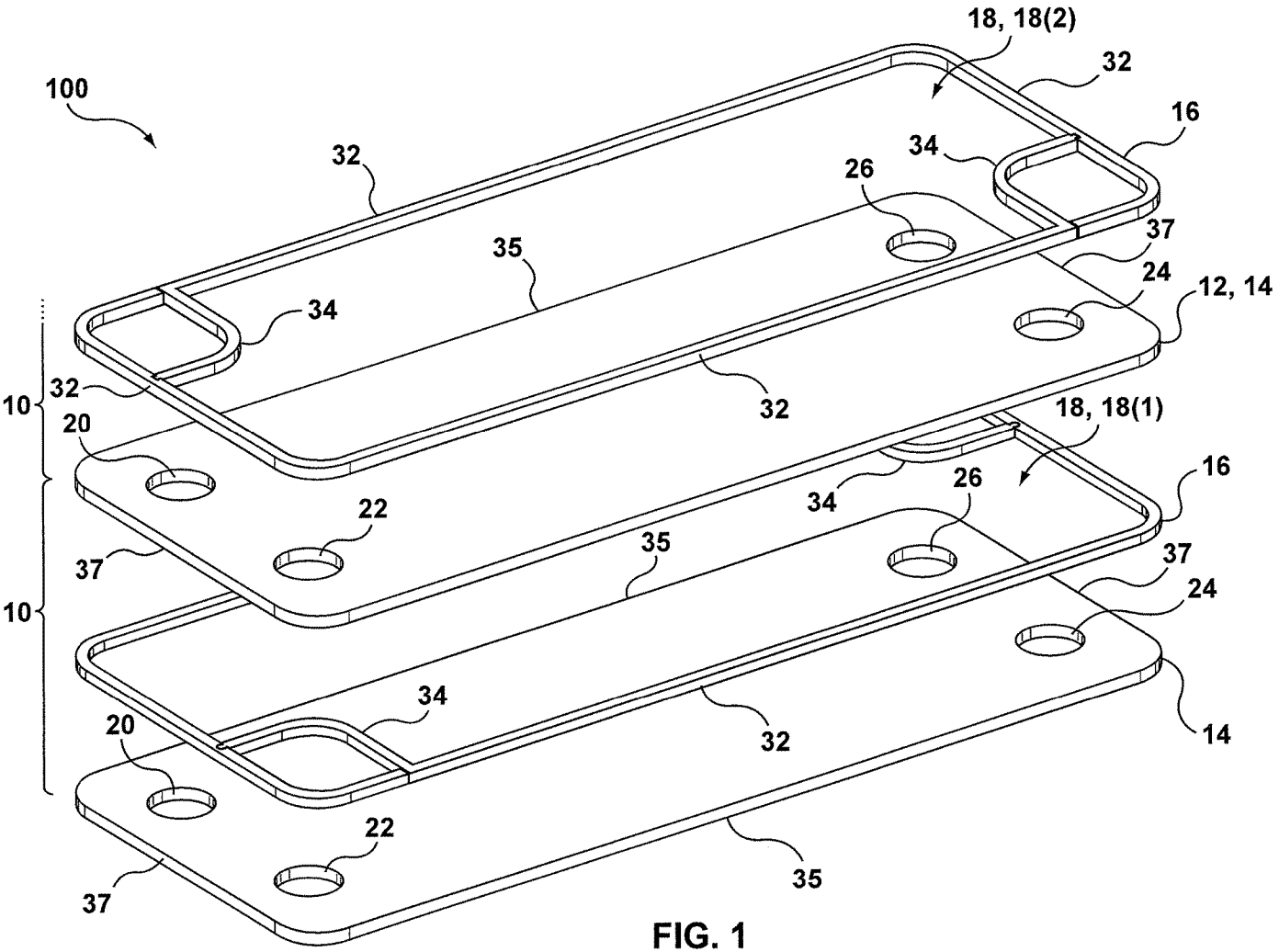
FIG. 1 is a perspective exploded view of a portion of a heat exchanger according to an exemplary embodiment of the present disclosure.

Referring now to FIG. 1 there is shown a portion of a heat exchanger 100 according to an example embodiment of the present disclosure. Heat exchanger 100 is comprised of fluid channel members 10 which serve as building blocks such that a plurality of fluid channel members 10 are stacked one on top of the other in order to form a heat exchanger for heating/cooling two different fluids flowing therethrough. It will be understood that suitable end plates (not shown) enclosing the stack of fluid channel members 10 and appropriate fluid inlet and outlet connections (not shown) for the various fluids flowing through the heat exchanger 100 would also be provided in accordance with principles known in the art. While the example embodiment shown in FIG. 1 shows the fluid channel member 10 with inlet/outlet openings arranged at respective ends of the generally rectangular plates 12, 14 for forming a parallel flow heat exchanger, it will be understood that various other forms of heat exchangers are also contemplated within the scope of the present disclosure as will be described in further detail below in connection with other example embodiments.

As shown, fluid channel member 10 comprises a pair of first and second plates 12, 14 that are spaced apart from one another and connected together by a frame member 16 so as to form a fluid passageway 18 therebetween. A turbulizer or other heat transfer augmenting device (not shown) may be positioned within fluid passageway 18 between plates 12, 14 depending upon the particular design and application of heat exchanger 100. Plates 12, 14 are essentially identical to each other and it will be understood that as fluid channel members 10 are stacked one on top of the other to form the heat exchanger 100, the first (or upper) plate 12 of one fluid channel member 10 becomes the second (or lower) plate 14 of the adjacent fluid channel member 10.

First and second plates 12, 14 are generally rectangular in shape and made from any suitable material, such as aluminum or stainless steel. Aluminum plates are preferably made from pre-clad aluminum brazing sheet. Stainless steel plates may be made from stainless steel sheet clad with a filler metal such as copper; or the plates may be pre-coated with another suitable filer metal; or a filler metal may be provided as a shim in contact with each plate surface. Plates 12, 14 are also generally flat and are each provided with four openings 20, 22, 24, 26 with one opening being positioned at each of the respective corners of the plates 12, 14. The openings 20, 22, 24, 26 serve as respective inlet/outlet ports for the inletting and discharging of a fluid into their corresponding fluid passageway 18. When a plurality of fluid channel members 10 are arranged one on top of the other, the openings 20, 22, 24, 26 align with the corresponding openings 20, 22, 24, 26 in the adjacent fluid channel member 10 to form respective pairs of inlet/outlet manifolds (not shown) for two separate fluids to flow through the heat exchanger 100 as is known in the art.

Frame member 16 comprises a first or outer peripheral sealing member 32 and a second or manifold sealing member 34. The first sealing member 32 generally follows the periphery or perimeter of the plates 12, 14 around the longitudinal and end edges 35, 37 of the plates 12, 14, the first sealing member 32 joining the first and second plates 12, 14 together at their peripheries in a spaced apart relationship thereby forming a leak-tight, fluid passageway 18 therebetween. The first sealing member 32, therefore, provides a fluid tight seal around the entire periphery of the fluid channel member 10, the plates 12, 14 and frame member 16 being joined together by brazing or any other suitable method to form a sealed, fluid passageway between plates 12, 14 and frame member 16.

The second sealing member 34 forms a fluid barrier or fluid boundary around two of the corresponding openings 20, 22, 24, 26 formed in the plates 12, 14. In the example embodiment shown in FIG. 1, one frame member 16 (i.e. the uppermost frame member 16 shown in FIG. 1) has the second sealing member 34 formed around diagonally opposed openings 20, 24 with the other frame member 16 (i.e. the lowermost frame member 16 shown in FIG. 1) having the second sealing member 34 formed around the opposite pair of diagonally opposed openings 22, 26. Accordingly, in the example embodiment shown, fluid can enter and exit the fluid passageway 18 formed between plates 12, 14 via openings 20, 22 while a second fluid flowing through the heat exchanger is prevented from entering fluid passageway 18 due to the positioning of the manifold sealing member 34, the second fluid instead being permitted to enter/exit the adjacent fluid passageway 18 via openings 24, 26. Accordingly, it will be understood that heat exchanger 100 is comprised of a series of alternating fluid flow passageways 18(1), 18(2) for the flow of a first heat exchanger fluid through a first set of fluid flow passageways 18(1) and a second heat exchange fluid through the second set of fluid flow passageways 18(2) which fluids are brought into heat transfer relationship by means of the alternating arrangement of the fluid flow passageways 18(1), 18(2) through the heat exchanger 100. It will be understood that while the second or manifold sealing members 34 are shown as being located so as to correspond to fluid openings at the diagonally opposed corners of the plates 12, 14 for a parallel-flow, single pass heat exchanger, other configurations are also possible depending upon the desired fluid flow path through the fluid channel members 10 and heat exchanger 100.

Frame member 16 is generally comprised of mating first and second frame portions 16(1), 16(2). In the subject example embodiment, the first and second frame portions 16(1), 16(2) are generally identical to each other, with the second frame portion 16(2) being rotated 180 degrees with respect to the first portion 16(1), or vice versa, as shown more clearly in FIGS. 2 and 3. Each of the first and second fame portions 16(1), 16(2) has one end 40 in the form of second sealing member 34 while the remainder of the frame portion 16(1), 16(2) follows the periphery of plates 12, 14, i.e. along the remainder of longitudinal edge 35, end edge 37 and around the corner of the plate 12, 14 and along a portion of the opposite longitudinal edge 35 before terminating at a second end 42. As shown, the first sealing member 32 of each of first and second frame portions 16(1), 16(2) follows approximately half of the periphery of the plates 12, 14 so that when frame portions 16(1), 16(2) are positioned in their mating relationship, a closed frame member 16 that follows the perimeter of plates 12, 14 is provided.

Figure 2:
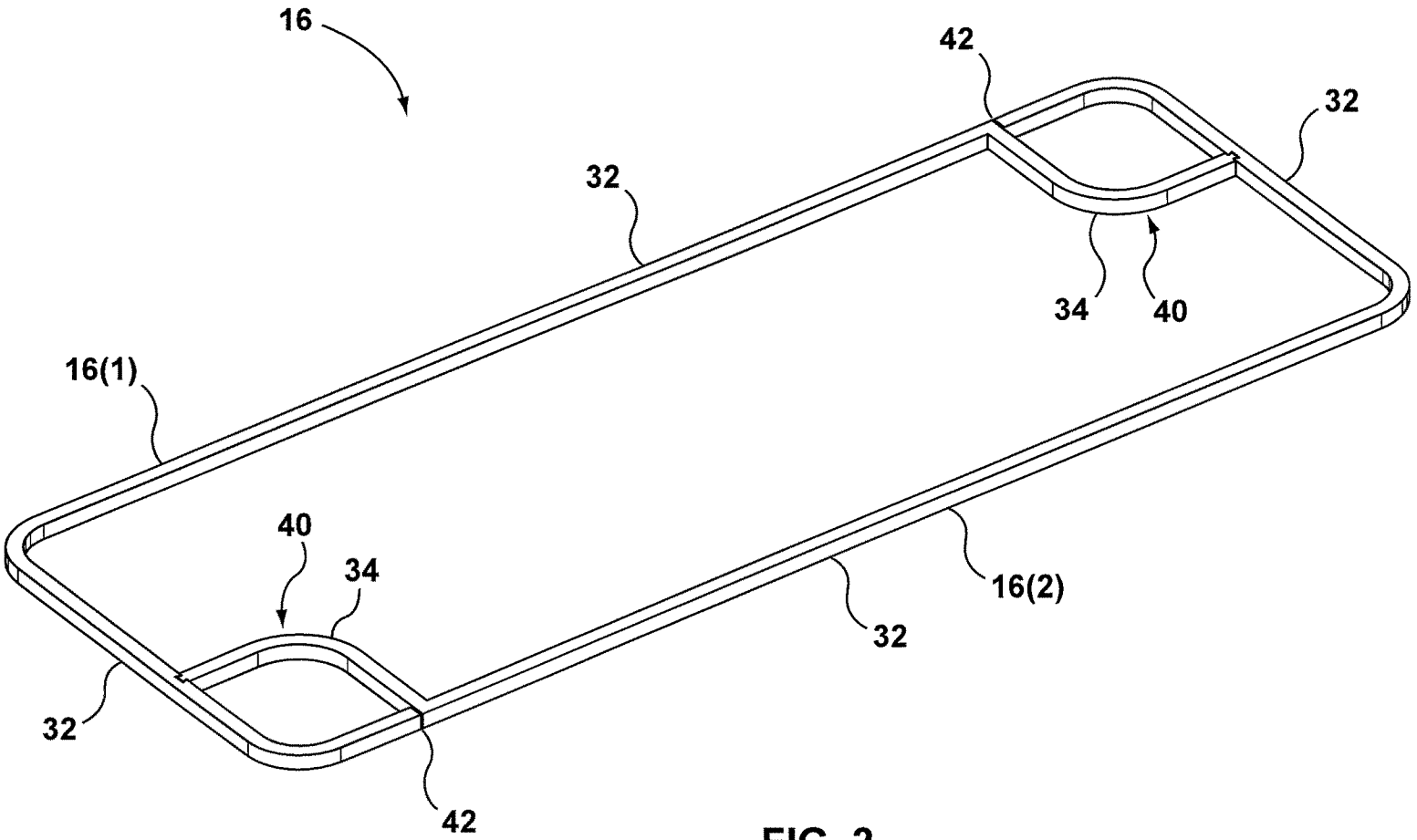
FIG. 2 is a top perspective view of a portion of the frame member of the heat exchanger shown in FIG. 1.
Figure 3:
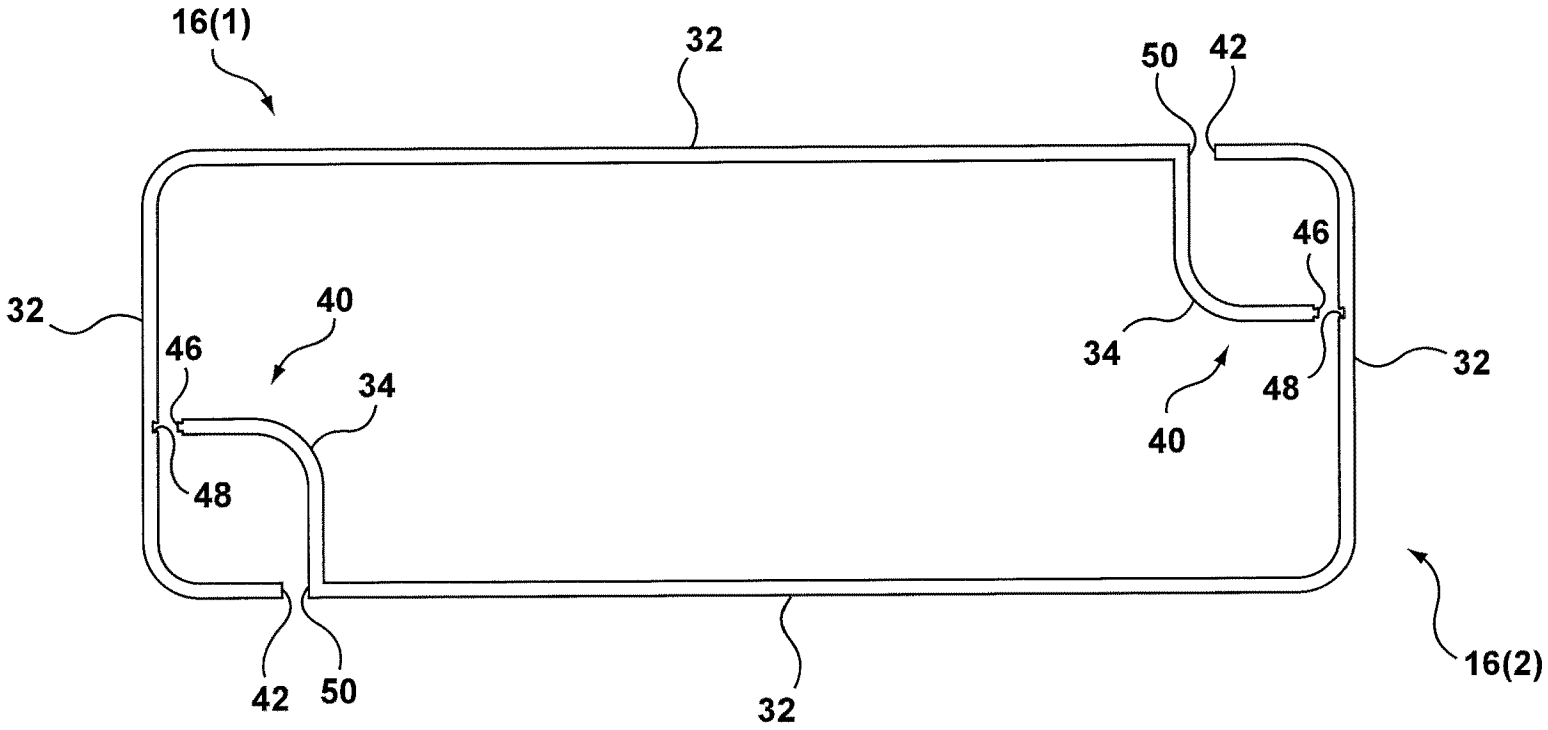
FIG. 3 is a top view of the frame member of FIG. 2 in an exploded state.

In order to ensure that the first and second frame portions 16(1), 16(2) are appropriately aligned with each other in order to form a robust, first seal 32 around the entire periphery of the plates 12, 14 and a robust second seal 34 around the manifold regions within fluid channel member 10 when the components are brazed or otherwise joined together, the first and second frame portions 16(1), 16(2) are provided with corresponding interlocking features to ensure the frame portions 16(1), 16(2) are securely positioned in their mating relationship. As shown in FIGS. 2 and 3, the first and second frame portions 16(1), 16(2) are provided with a mechanical connection. More specifically, the first and second frame portions 16(1), 16(2) each have a first end 40 that forms the second or manifold sealing members 34, the first end 40 terminating at a free end that serves as a male interlocking member 46 in the form of a dovetail projection. A corresponding inside edge of the first sealing member 32 of the corresponding first or second frame portion 16(1), 16(2) is provided with a female interlocking member 48 in the form of a recess that corresponds to the dovetail projection found at the end of the first end 40 of the other frame portion 16(1), 16(2). Accordingly, when the two frame portions 16(1), 16(2) are positioned together to form frame member 16, the male interlocking member 46 fits within the female interlocking member 48 thereby aligning and securely positioning the two frame portions 16(1), 16(2) in their mating relationship forming a joint. Accordingly, frame portions 16(1), 16(2) are self-aligning and self-fixturing.

The second end 42 of frame portions 16(1), 16(2) is generally provided with a blunt end edge, or free end, which simply abuts up against a corresponding end edge 50 of the first sealing member 32 where of the first sealing member 32 ends and transitions into the second or manifold sealing member 34 forming a butt joint. Although, it will be understood that the second end 42 could also be provided with similar interlocking features, if desired. However, provided that one of the free first or second ends 40, 42 of the frame portions 16(1), 16(2) is provided with interlocking features to form a mechanical connection between the two, the first and second frame portions 16(1), 16(2) should be self-aligning and self-fixturing in order to facilitate assembly/manufacture of the heat exchanger 100.

It will be appreciated by one skilled in the art, that in any of the interlocking, intersecting, or overlapping frame joints described above or in the following sections, the geometry and clearances in these joints is selected to be sufficient to encourage capillary flow of molten brazing filler metal, so that during brazing assembly the mechanical joints are securely and hermetically bonded. That is, the frame ends or frame portions are bonded to each other, and also the entire frame is bonded to the mating heat exchanger plates 12, 14 to create strong and leak-tight fluid passages 18.

Figure 4:
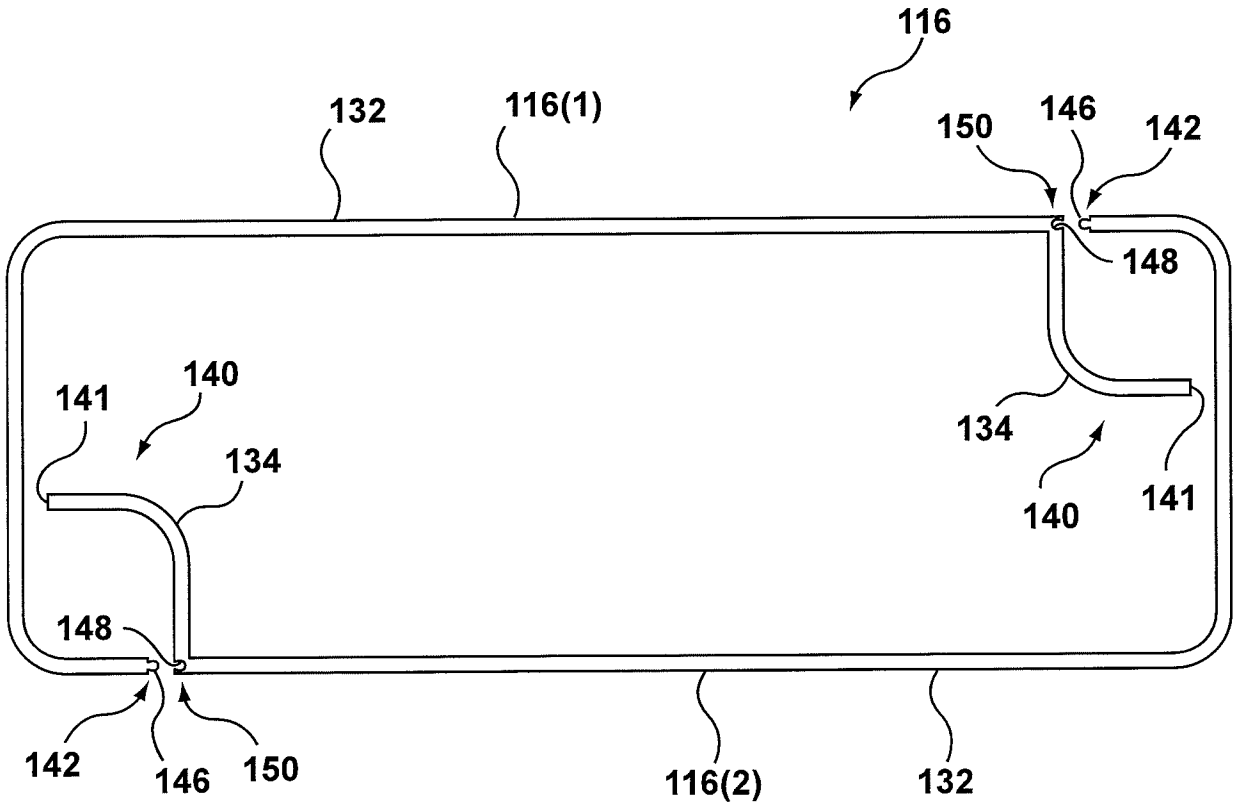
FIG. 4 is a top view of a frame member according to another exemplary embodiment of the present disclosure in an exploded state showing an alternate mechanical connection.

Referring now to FIG. 4 there is shown another example embodiment of a frame member 116 according to the present disclosure wherein corresponding or similar features will be referred to with similar reference numerals increased by a factor of 100. In this embodiment, frame member 116 comprises first and second frame portions 116(1), 116(2) that are similar to frame portions 16(1), 16(2) except for the location and style of mechanical connection or joint provided for interlocking the two frame members 116(1), 116(2) together in their mating relationship. More specifically, the first end 140 of each of frame portions 116(1), 116(2) terminates with a free, blunt end edge 141 for forming a butt joint against a corresponding interior surface of the corresponding frame portion 116(1). 116(2), while the second end 142 terminates at a free end formed with a male interlocking member 146 in the form of a rounded jigsaw or "puzzle-piece" projection.

A corresponding female interlocking member 148 in the form of a recess that corresponds to the rounded jigsaw or "puzzle-piece" male interlocking member 146 is formed in the corresponding end edge 150 of the mating frame portion 116(1), 116(2) where the first sealing member 132 transitions into the second sealing member 134 at the first end 140 of the frame portion 116(1), 116(2). When the first and second frame portions 116(1), 116(2) are positioned together to form frame member 116, the male interlocking member 146 fits within the female interlocking member 148 thereby forming a mechanical connection or joint within the first sealing member 132 formed by the two frame portions 116(1), 116(2), the mechanical connection thereby aligning and securely positioning the two frame portions 116(1), 116(2) in their mating relationship. Accordingly, frame portions 116(1), 116(2) are self-aligning and self-fixturing.

Figure 5:
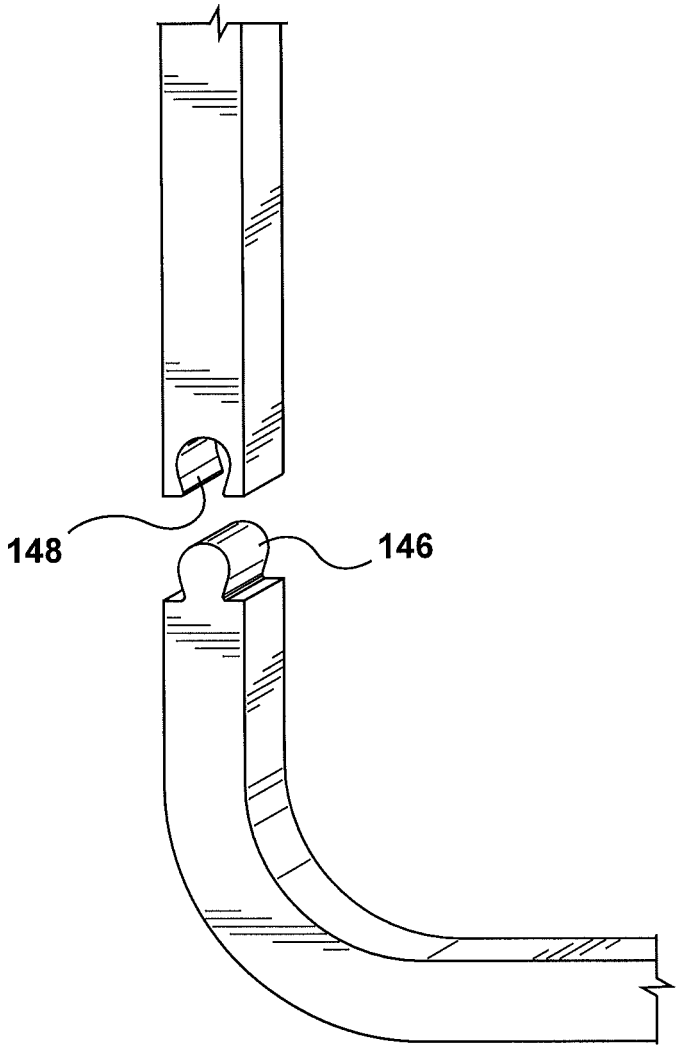
FIG. 5 is a detail view of the mechanical connection of the embodiment shown in FIG. 4.
Figure 6:
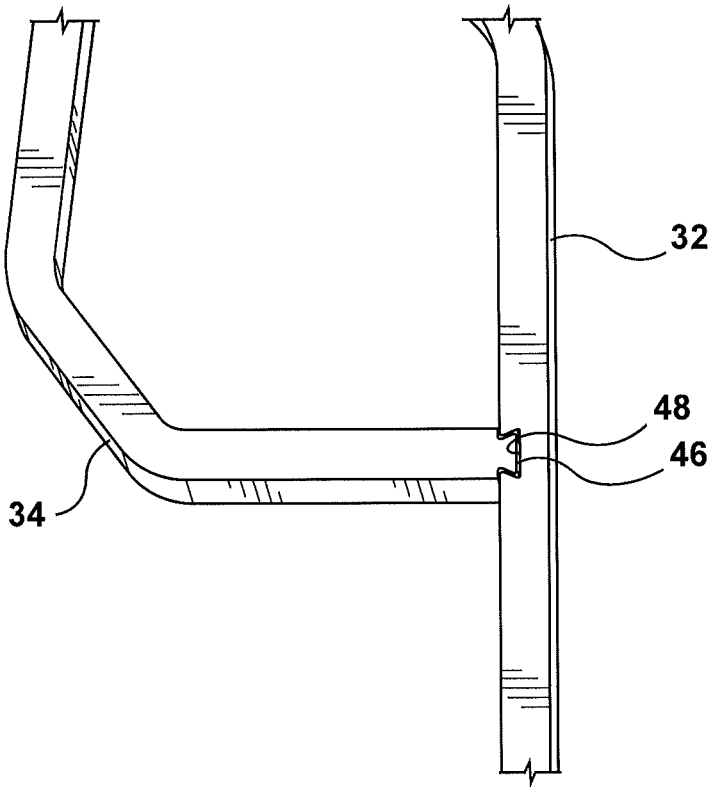
FIG. 6 is a detail view of the mechanical connection of the embodiment shown in FIG. 3.

As shown in the embodiments of FIGS. 1-4, the self-aligning or self-fixturing means or features can be provided within, or in-line with, the first sealing member 132, as shown primarily in FIG. 4 in respect of frame member 116, or the self-aligning or self-fixturing means can be provided at a perpendicular junction between the two mating frame portions is as shown primarily in the embodiment of FIGS. 2 and 3 in respect of frame member 16. Detailed views of the jigsaw and dovetail interlocking members are shown in FIGS. 5 and 6.

A further embodiment of a frame member 216 is shown in FIG. 7 where once again similar reference numerals increased by a factor of 200 have been used to identify similar features of the frame member.

As shown, frame member 216 is comprised of two generally identical frame portions 216(1), 216(2), with one frame portion 216(1), 216(2) being rotated 180 degrees with respect to the other frame portion 216(1), 216(2). Frame portions 216(1), 216(2) each comprise a first sealing member 232 that extends around a portion of the periphery of the corresponding plates 12, 14 and has one end 240 in the form of the second or manifold sealing member 234. The second or manifold sealing member 234 extends or transitions from the first sealing member 232 towards the interior region of the frame member 216 in order to form the boundary or fluid barrier that will be positioned around one of the fluid openings formed in corresponding plates 12, 14. The first sealing member 232 extends along one of the longitudinal edges 35, an end edge 37 and a portion of the opposite longitudinal edge 35 of the plates 12, 14 so as to provide a complete seal or boundary around the perimeter of the plates 12, 14 when the two frame portions 216(1), 216(2) are positioned in their mating relationship and positioned between plates 12, 14 to form fluid channel member 10.

Figure 7:
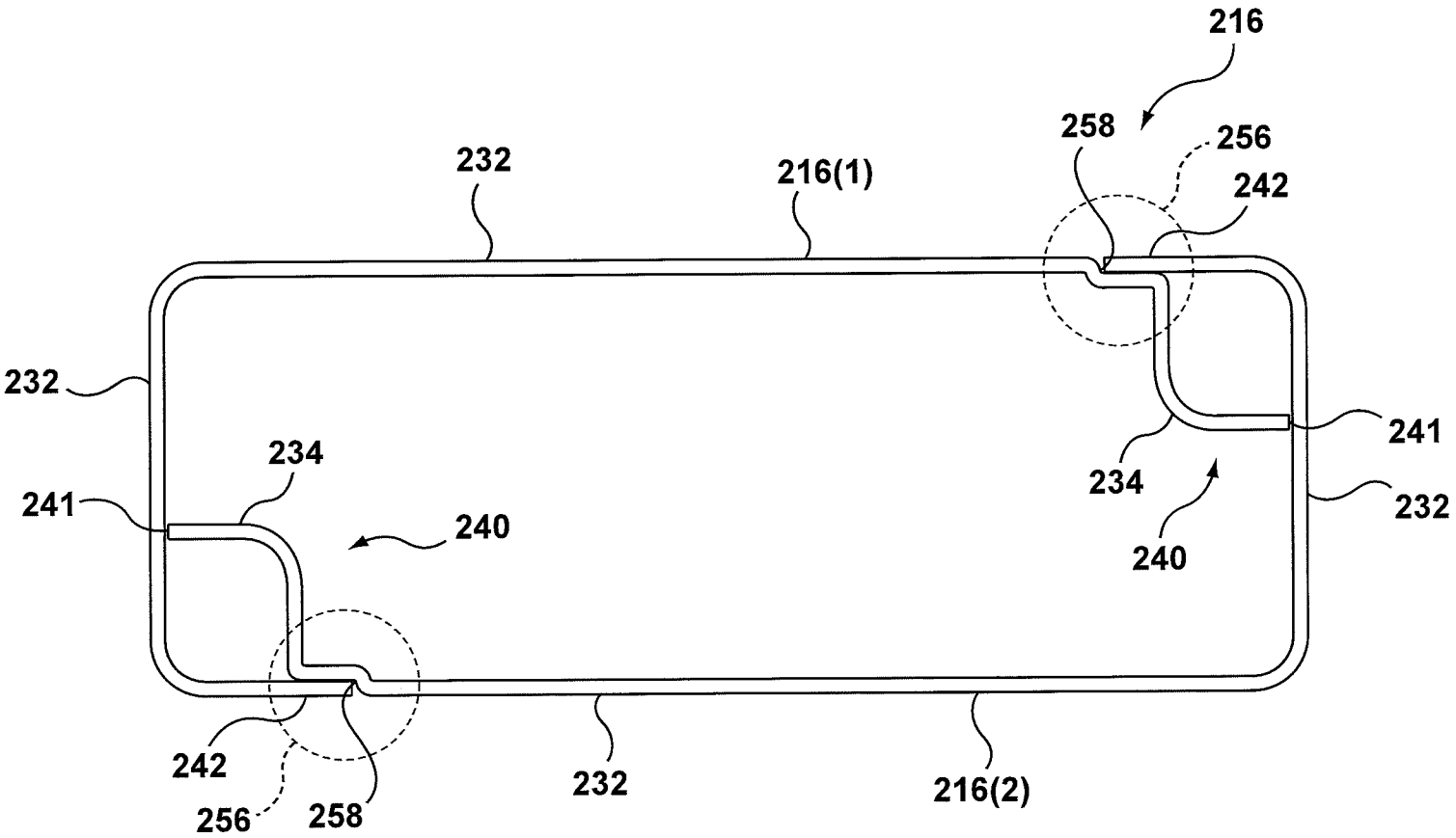
FIG. 7 is a top view of a frame member according to another exemplary embodiment of the present disclosure.

In the subject example embodiment, rather than having a mechanical connection with interlocking features in the form of a jigsaw or dovetail connection as described above in connection with FIGS. 2-6, the embodiment shown in FIG. 7 incorporates a stepped mating connection or overlapping joint 256 (see area encircled with dotted lines in FIG. 7) where the first and second frame portions 216(1), 216(2) meet at the transition area between a portion of the first sealing member 232 and a the second sealing member 234. As shown, frame portions 216(1), 216(2) each have a first end 240 that forms the second or manifold sealing members 234, the first end 240 terminating at a blunt end edge or free end 241 which abuts against the interior edge or surface of a portion of the first sealing member 232 of the corresponding frame portion 216(1), 216(2) when the frame portions 216(1), 216(2) are positioned together forming a perpendicular butt joint. The first and second frame portions 216(1), 216(2) are also each provided with a recessed or indented region 258 formed along the exterior surface or edge of the longitudinal edge portion of the first sealing member 232 proximal to where the first sealing portion 232 transitions into the second sealing member 234. The recessed or indented region 258 is adapted for receiving the corresponding free end or end section 242 of the other frame portion 216(1), 216(2) when the two frame portions 216(1), 216(2) are positioned together in their mating relationship forming an overlapping joint so that the two frame portions 216(1), 216(2) form a generally flush or uniform edge around the periphery of the fluid channel members 10. While the absolute end edge of free end 242 may not fully abut with the corresponding end portion of recessed area 258, the overall overlap between the free end 242 and the recessed area 258 has been found to provide a sufficient joint between the two frame members 216(1), 216(2). Accordingly, once again frame portions 216(1), 216(2) are self-aligning and self-fixturing as they are positioned in their mating arrangement.

Figure 8:
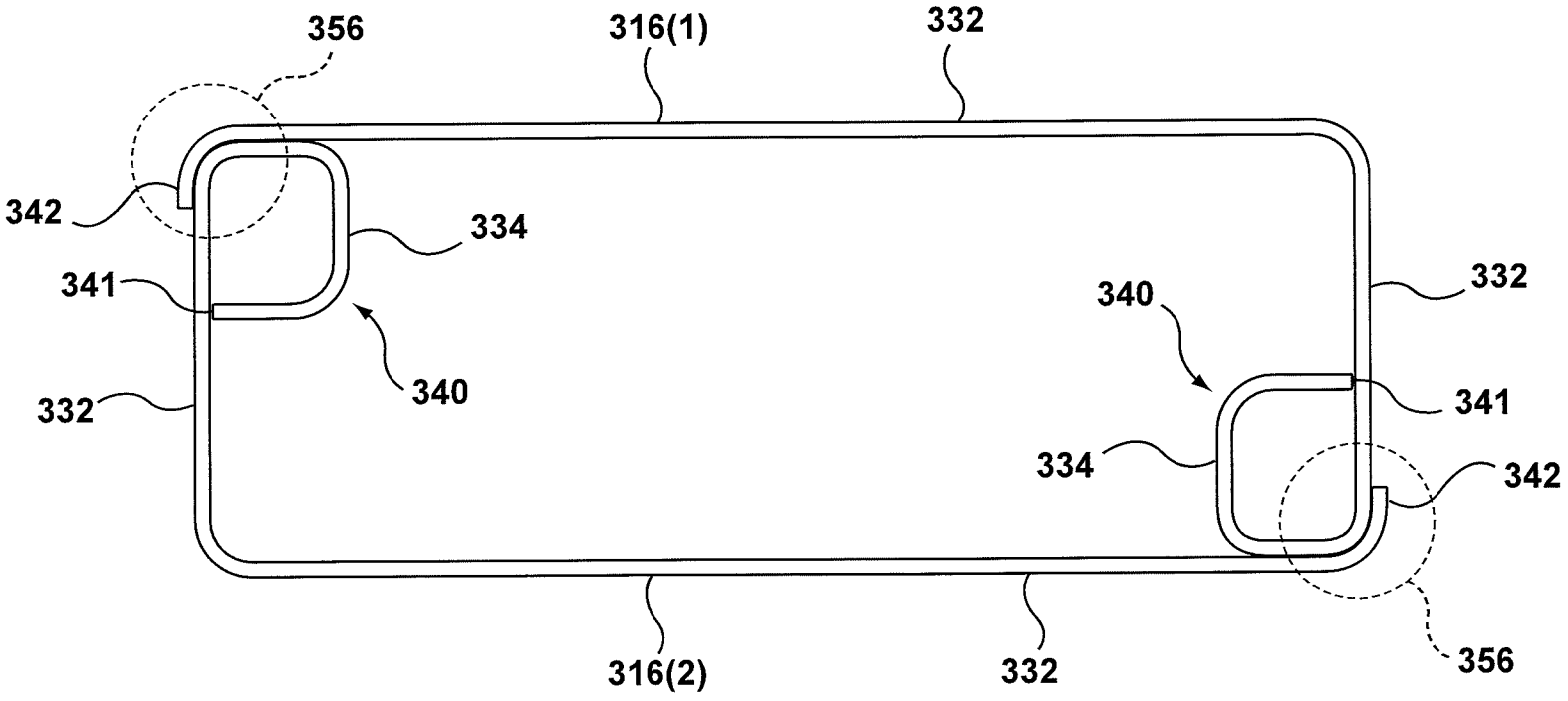
FIG. 8 is a top view of a frame member according to another exemplary embodiment of the present disclosure.

Another example embodiment of a frame member 316 is shown in FIG. 8 wherein the frame portions 316(1), 316(2) are arranged in their mating relationship with the free end 342 of one of frame portions 316(1), 316(2) wrapping around a corner of the other mating frame portion 316(1), 316(2) forming an overlapping joint. While this particular arrangement does not provide for a flush or uniform edge around the outer periphery of the frame member 316, an overlapping joint with a non-uniform edge may be suitable for certain applications. As shown in the drawings, the first and second frame portions 316(1), 316(2) each comprise a first sealing member 332 that follows a longitudinal edge 35 and end edge 37 of the plates 12, 14, the first and second frame portions 316(1), 316(2) having a first end 340 that forms the second sealing member 334, the first end 340 terminating in a free end or blunt, end edge 341 that abuts against the interior edge or surface of the corresponding end edge portion 37 of the first sealing member 332 of the same frame portion 316(1), 316(2). The second end 342 of frame portions 316(1), 316(2) is generally provided with a free or blunt end edge which, as described above, simply wraps around the corner of the mating frame portion 316(1), 316(2).

Figure 8A:
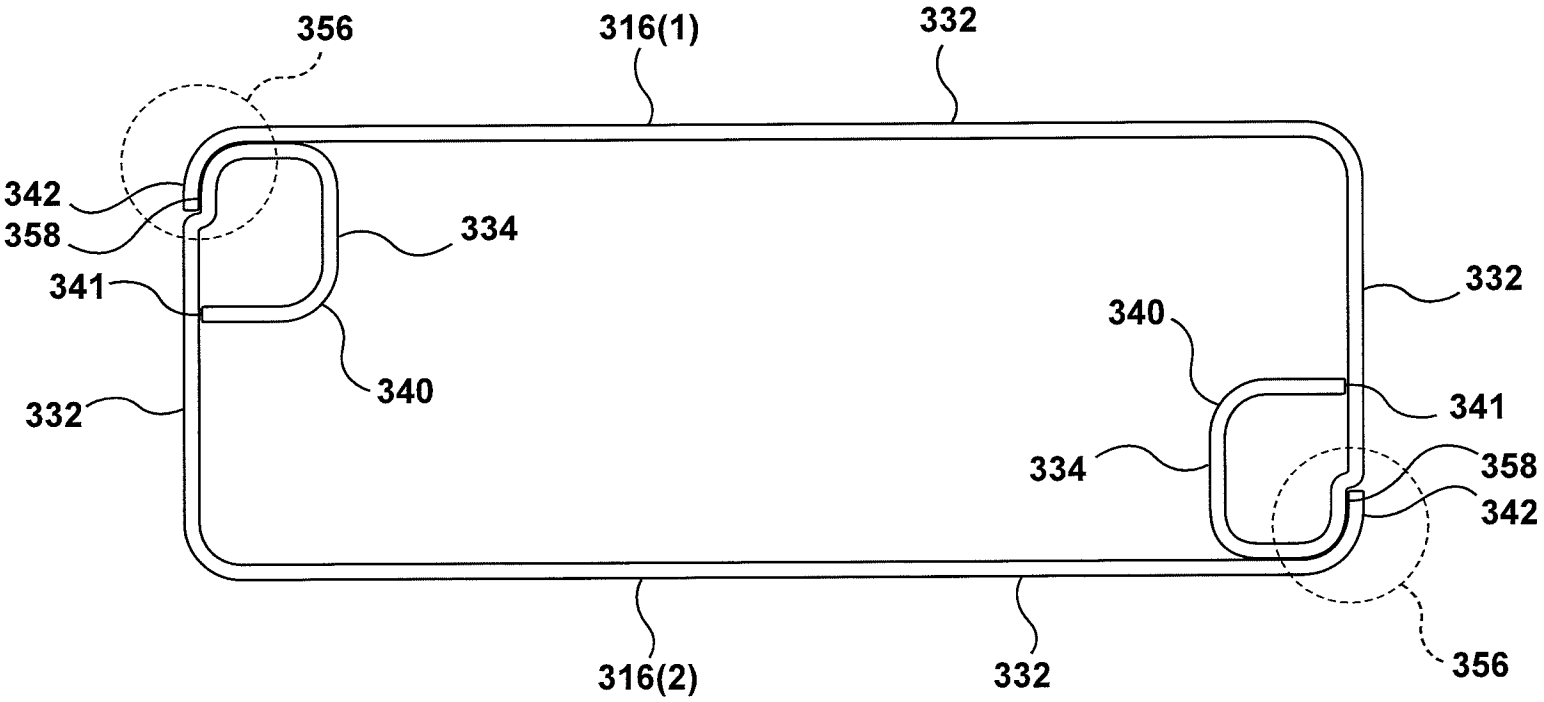
FIG. 8A is a top view of a variation of the frame member shown in FIG. 8.

FIG. 8A illustrates a variation of the embodiment shown in FIG. 8 wherein rather than having an overlapping joint with a non-uniform outer edge (as shown in the encircled area 356 in FIG. 8), a stepped connection similar to that shown in FIG. 7 is incorporated into the overlapping joint in order to create a generally flush or uniform outer peripheral edge for frame member 316. In the subject embodiment, the stepped connection is incorporated into the end edge 37 region of the frame member 316 as opposed to being incorporated into the longitudinal edge 35 portion of the first sealing member as in the case of the embodiment shown in FIG. 7. In this embodiment, the end edge 37 portion of the first sealing member 332 is provided with a recessed or indented region 358, the recessed or indented region 358 adapted for receiving the corresponding free end or end section 342 of the corresponding frame portion 316(1), 316(2) when the two frame portions 316(1), 316(2) are positioned together in their mating relationship. Accordingly, the embodiment shown in FIG. 8A offers a variation wherein the two frame portions 316(1), 316(2) form a flush or uniform edge around the periphery of the plates 12, 14.

Figure 9:
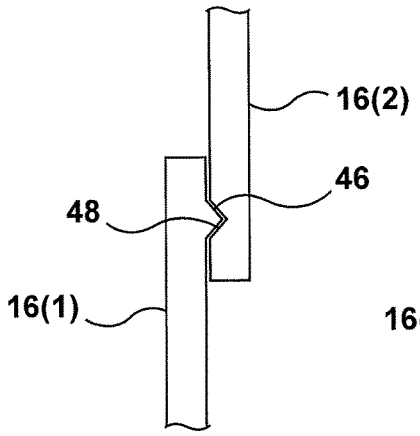
FIG. 9 is a detail view of an inter-locking connection according to another example embodiment of the present disclosure.
Figure 9A:
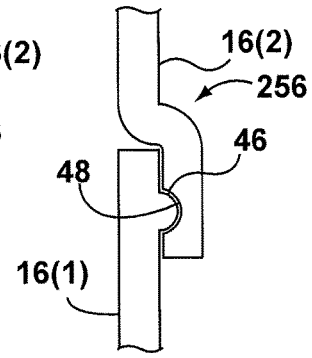
FIG. 9A is a detail view of a variation of the inter-locking connection shown in FIG. 9.
Figure 10:
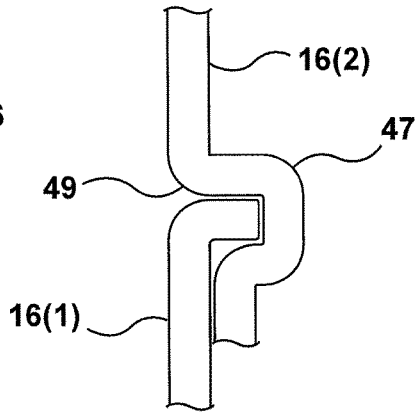
FIG. 10 is a detail view of an inter-locking connection according to another example embodiment of the present disclosure.

Various other forms of interlocking or self-aligning connections are contemplated within the scope of the present disclosure as shown, for example, in FIGS. 9, 9A and 10. For ease of reference, reference will be made to frame member 16 and frame portions 16(1), 16(2) although it will be understood that various other forms of interlocking or self-aligning connections could be incorporated into any of the frame members 16, 116, 216, 316 or frame portions 16(1), 16(2), 116(1), 116(2), 216(1), 216(2), 316(1), 316(2) described above.

In FIG. 9, an overlapping connection or joint between mating frame portions 16(1), 16(2) is shown wherein an inside or interior edge of one frame portion 16(1) is provided with a male projection 46 while the outer edge of the corresponding frame portion 16(2) is provided with a corresponding female mating component or recess 48 for receiving the male projection when the frame portions 16(1) are arranged in their mating relationship. It will be understood that this type of connection could be incorporated into the stepped connection 256 shown in FIG. 7 or FIG. 8A or into the overlapping connection 356 shown in FIG. 8. FIG. 9A illustrates a variation to the overlapping connection shown in FIG. 9 wherein the overlapping connection with male and female mating components 46, 48 is incorporated into a stepped connection 256 in order to achieve a flush or uniform edge around the exterior of the frame member 16 when the first and second frame portions 16(1), 16(2) are positioned in their mating relationship.

FIG. 10 illustrates another form of interlocking or self-aligning connection wherein one frame portion 16(2) is bent or pinched so as form a pocket 47 within the outer edge of the frame portion 16(2) for receiving a corresponding bent or hooked-end 49 of the corresponding frame portion 16(1). In order to maintain a flush or uniform edge around the perimeter of the frame member 16, the portion of the frame that continues after the formation of the pocket 47 is recessed or set-back with respect to the portion of the frame prior to the formation of the pocket 47 by a distance corresponding to the width of the material that forms the frame 16. This ensures that the overlapping of the frame portions 16(1), 16(2) at the interlocking or mechanical connection forms a flush or generally edge around the exterior of the frame member 16. Once again, this interlocking or self-aligning connection could be incorporated into the stepped connection 256 or into the overlapping connection 356 shown in FIGS. 7 and 8, for example.

Figure 16:
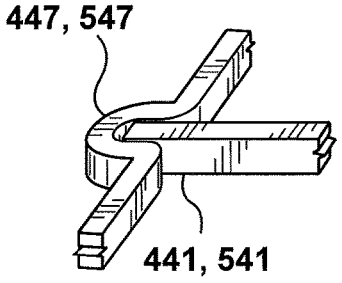
FIG. 16 is a detail view of an inter-locking connection between frame member components of the embodiments shown in FIGS. 14 and 15.

While the frame members 16, 116, 216, 316 have all been shown as being formed by lengths of material having a generally square cross-sectional area, it will be understood that the frame members 16, 116, 216, 316 may also be formed with lengths of material having a rectangular, circular or oval cross-sectional shape. The lengths of material may be any suitable form of material, such as lengths of wire or rods or bars that is capable of being bent or formed into the desired configurations. Although not essential, in instances where circular or oval lengths of material are used, such as circular or oval wire or rods, to form frame members 16, 116, 216, 316, the frame members may be preferably flattened on their upper and lower surfaces, either before or after assembly. Provided that sufficient contact is provided between the frame member 16, 116, 216, 316 and the corresponding surfaces of the plates 12, 14 to achieve the desired seal, the specific cross-sectional shape of the wire or rod-like material used to form frame member 16, 116, 216, 316 may vary depending upon the particular design and/or application of the heat exchanger 100. For instance, certain diameter wire and/or rod material, or wire and/or rod material with certain aspect ratios, may have manufacturing limitations associated with the ability of the material to be bent to the desired radius to achieve a particular configuration of frame member 16, 116, 216, 316. In instances where the fluid channel members 10 must be appropriately sized to accommodate a turbulizer or other heat transfer augmentation device, a wire or rod of material having the required height to achieve the desired spacing apart of the plates 12, 14 may result in the cross-sectional area of the wire or rod for forming the frame member being such that accurate bending of the wire or rod to achieve the desired configuration is difficult to achieve. Therefore, in certain instances where a sharp bend radius may be required to form the frame members, a tall, thin rectangular bar or a thick ribbon of material positioned on its edge may be preferable, as shown for instance in FIG. 16. Accordingly, it will be understood that the square cross-sectional shape has been shown for illustration purposes only and that rectangular, circular or oval shaped wire or rod material, or a thick ribbon or bar of material arranged on its edge or any other suitable shape of material may be used to form frame members 16, 116, 216, 316.

Figure 13:
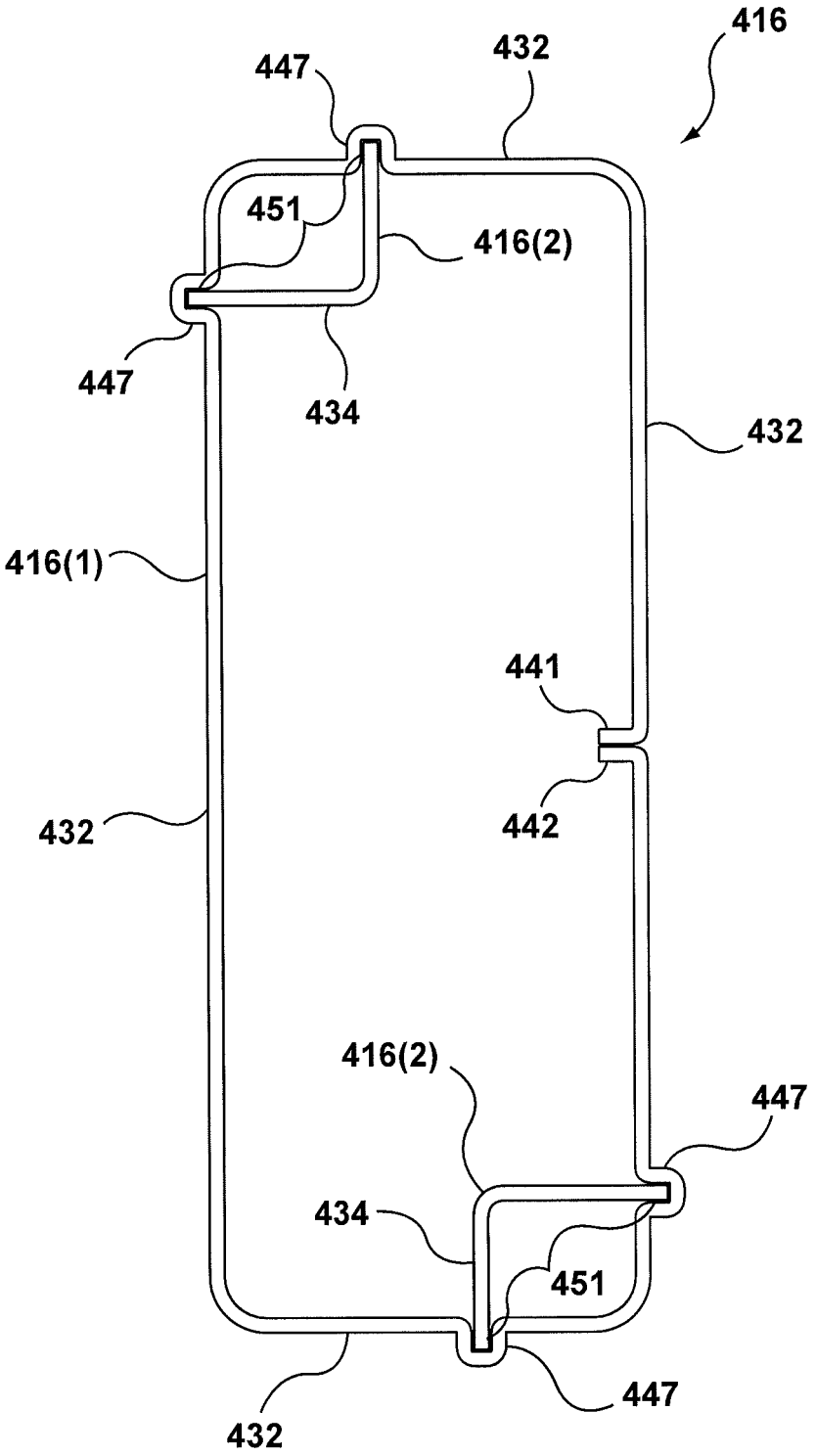
FIG. 13 is a top view of a frame member according to another exemplary embodiment of the present disclosure.

Referring now to FIG. 13 there is shown another example embodiment of a frame member 416 according to the present disclosure. In this embodiment, frame member 416 is comprised of a first frame portion 416(1) that forms the entire first sealing member 432 corresponding, generally, to the outer perimeter or periphery of the heat exchange plates 12, 14. The first frame portion 416(1) is formed by a length of frame material that is bent into the desired configuration, the first frame portion 416(1) having first and second free ends 441, 442 in the form of hooked ends that come together to form a butt joint.

Second frame portions 416(2) form the second sealing member 434 in the form of a fluid barrier or boundary that will encircle or surround one of the fluid openings 20, 22, 24, 26 in plates 12, 14. The second frame portions 416(2) are positioned in the interior region defined by the first frame portion 416(1) at diagonally opposed corners thereof, the respective ends 451 of the second frame portions 416(2) being received within corresponding pockets 447 formed in the interior surface or edge of the first frame portion 416(1), similar to the interconnection described in relation to the embodiment shown in FIG. 10. While the subject example embodiment of frame member 416 has been shown as being adapted for a single pass, parallel flow heat exchanger with the corresponding inlet and outlet openings/manifolds being located in diagonally opposed corners of the plates, it will be understood that frame members comprising one-piece first sealing members and separate second frame portions forming the second sealing member can be modified for different configurations of heat exchangers.

Figure 14:
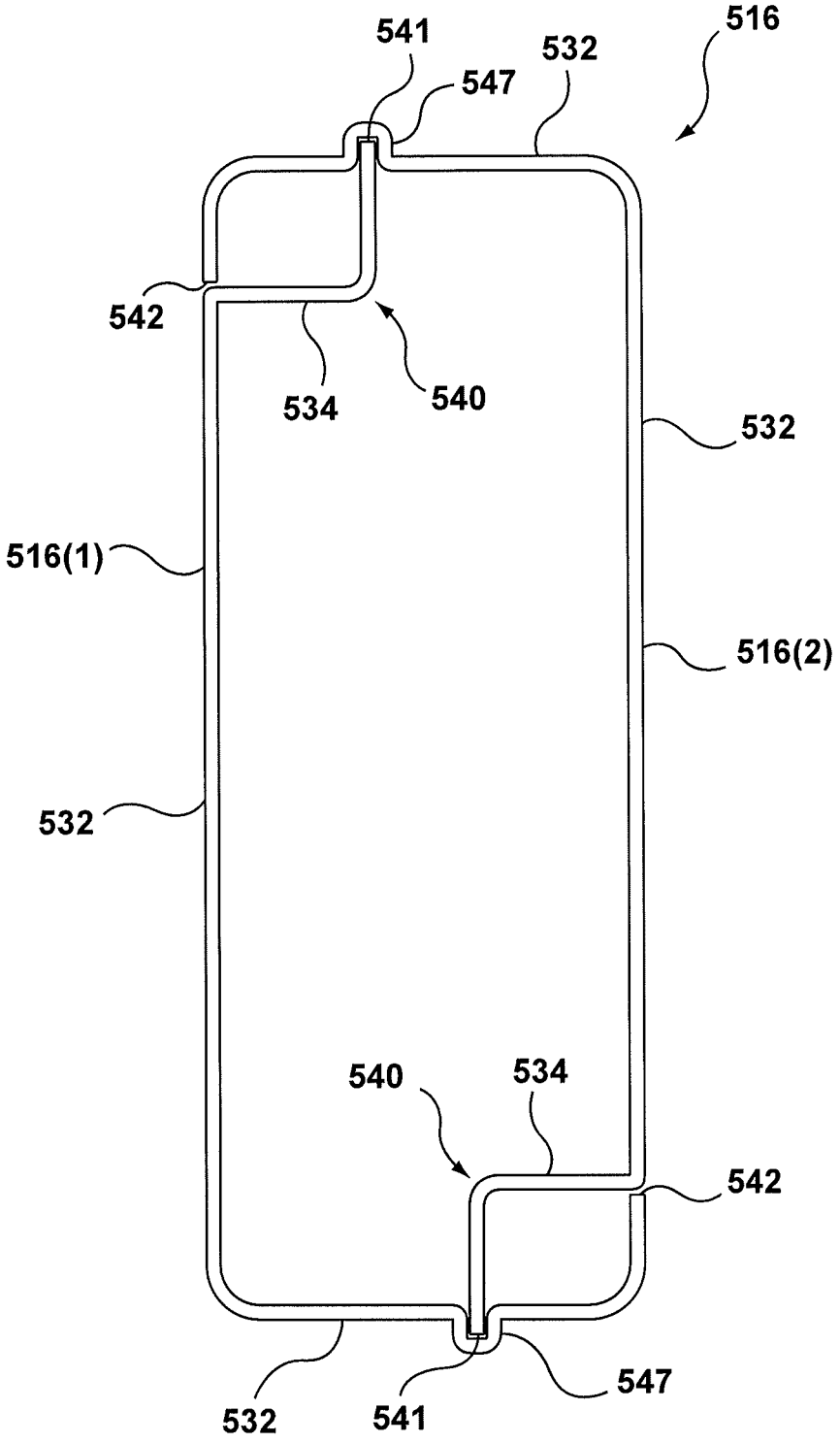
FIG. 14 is frame member according to another exemplary embodiment of the present disclosure.

Referring now to FIG. 14, there is shown another example embodiment of a frame member 516 according to the present disclosure. Frame member 516 is similar to the frame members 16, 116, 216, 316 in that it too is comprised of first and second frame portions 516(1), 516(2) that are generally identical to each other, with the second frame portion 516(2) being rotated 180 degrees with respect to the first portion 516(1), or vice versa. Each of the first and second fame portions 516(1), 516(2) has one end 540 in the form of second sealing member 534 while the remainder of the frame portion 516(1), 516(2) generally follows the periphery of plates 12, 14, i.e. along the remainder of longitudinal edge 35, end edge 37 and around the corner of the plate 12, 14 and along a portion of the opposite longitudinal edge 35 before terminating at a second end 542. Rather than providing a more complex dovetail or jigsaw mechanical connection between the first and second frame portions 516(1), 516(2) at the junction between the end edge 541 of the first end 540 of the frame portions 516(1), 516(2), the corresponding interior surface or mating edge of the end edge 37 portion of the first sealing member 532 of the corresponding frame portion 516(1), 51692) is provided with a recess or pocket 547 for receiving the blunt end edge 541 of the corresponding frame portion 516(1), 516(2) when the two frame portions are brought into their mating relationship. By having the end edges 541 of the first end 540 of the frame portions 516(1), 516(2) received within the corresponding recesses or pockets 547 formed in the corresponding portion of the first sealing member 532, the first and second frame portions 516(1), 516(2) are brought into their self-aligning and self-fixturing mating relationship. This particular embodiment is suitable for applications where a flush or uniform exterior edge around the frame members 516 is not required.

Figure 15:
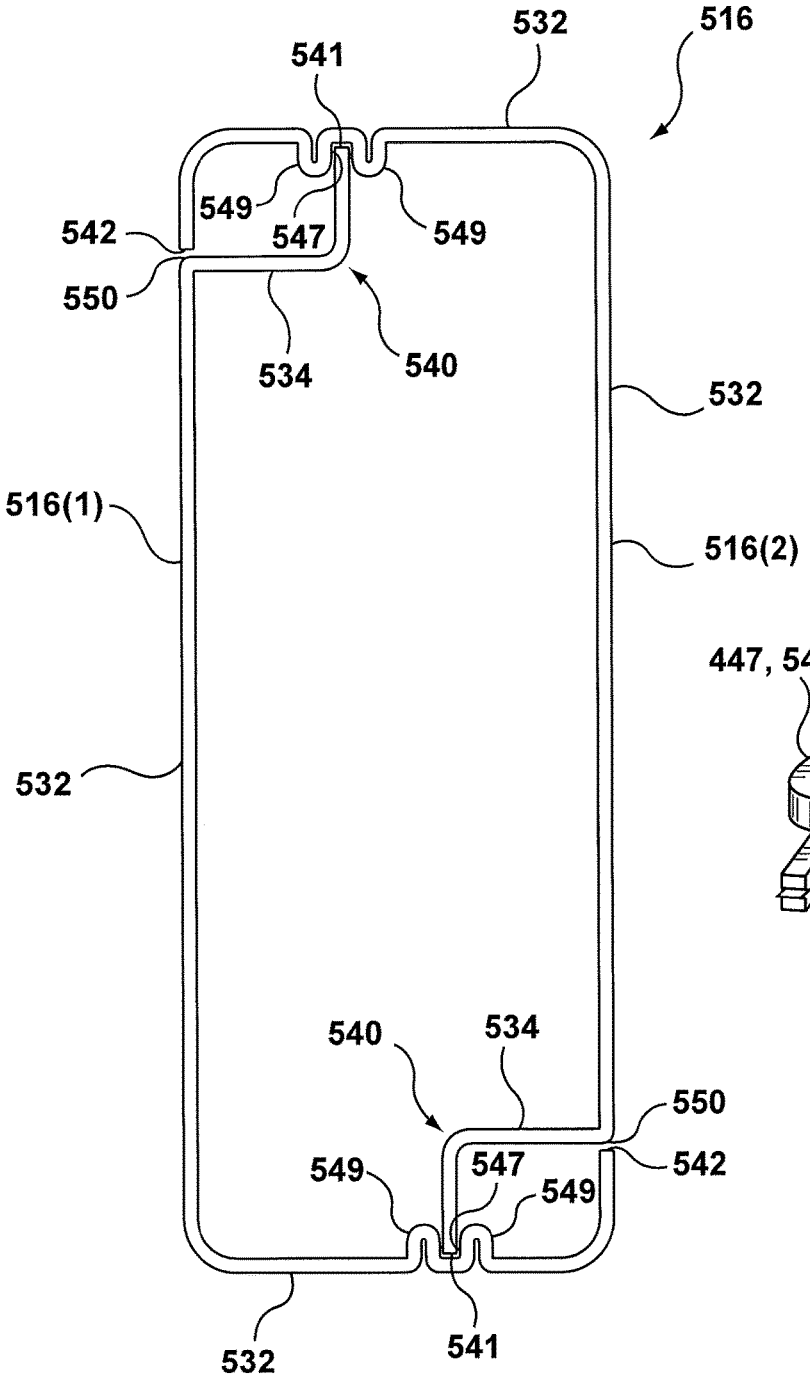
FIG. 15 is a top view of a variation of the frame member shown in FIG. 14.

Referring no w to FIG. 15 there is shown a variation of the frame member 516 shown in FIG. 14. In this embodiment, rather than having pockets 547 formed in the exterior edge of the frame portions 516(1), 516(2) resulting in a non-uniform exterior edge of frame member 516, the recess or pocket 547 for receiving the end edge 541 of the first end 540 of the corresponding frame portion 516(1), 516(2) is formed on the interior edge or surface of the corresponding portion of the first sealing member 532 along the end edge 37 of the plates 12, 14. More specifically, two slightly spaced apart protrusions 549 are formed by pinching or bending the material forming the frame portions 516(1), 516(2) with a rather small or tight bend radius so as to create the recess or pocket 547 between the two protrusions. This variation allows for a flush or uniform exterior edge around the perimeter or periphery of the resulting frame member 516 when the first and second frame portions 516(1), 516(2) are brought into their mating relationship.

While all of the above-described embodiments relate primarily to frame members suitable for forming fluid channel members 10 for a single pass heat exchanger wherein the fluid enters the fluid flow passageway 18 through an inlet opening positioned at one corner of the plate 12, 14 and exits the fluid flow passageway 18 at a diagonally opposed corner, variations to the fluid channel members 10 so as to accommodate U-flow or two-pass heat exchanger applications are also contemplated within the scope of the present disclosure.

Figure 17:
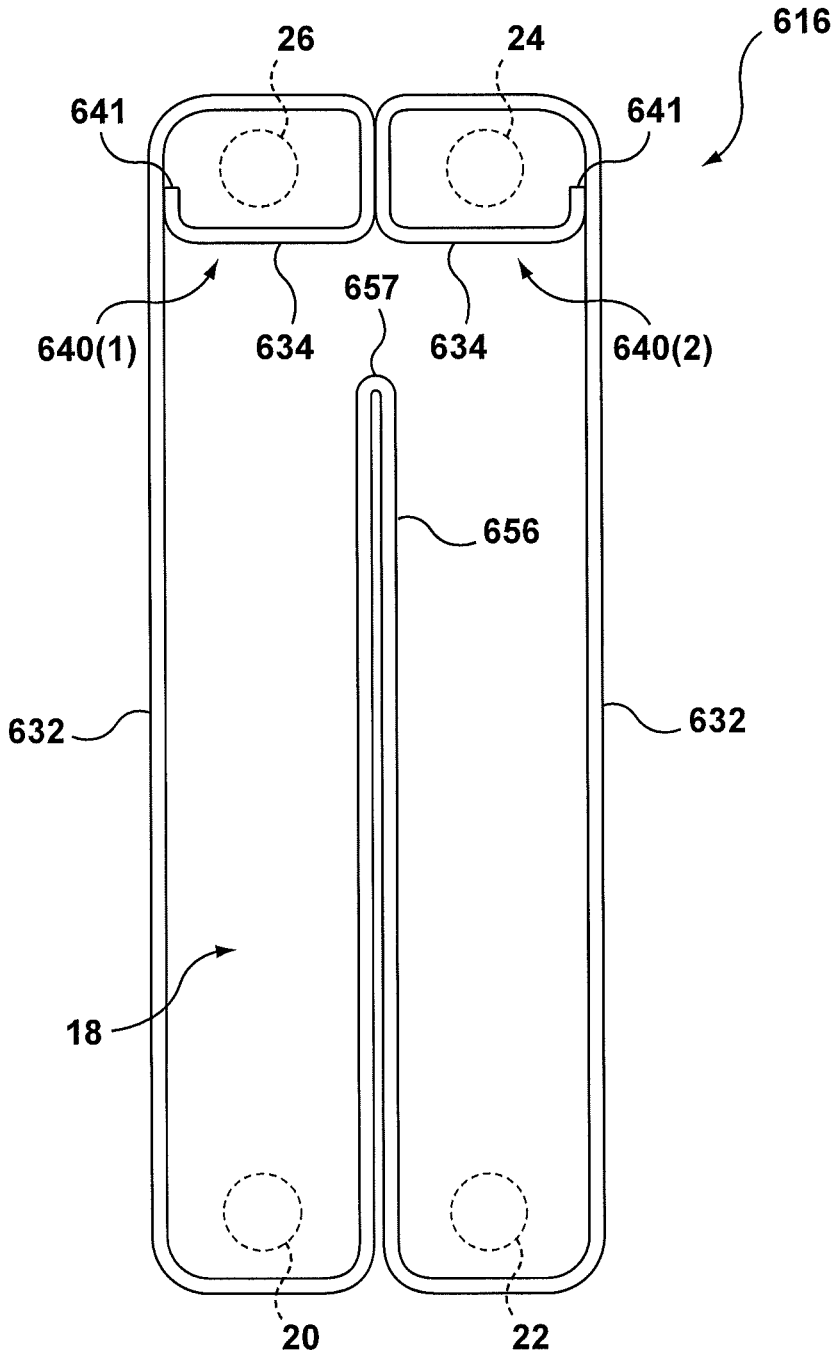
FIG. 17 is a top view of a frame member according to another exemplary embodiment of the present disclosure for forming a two-pass or U-flow fluid channel.

Referring now to FIG. 17 there is shown a frame member 616 according to another example embodiment of the present disclosure that is adapted to create stackable fluid channel members 10 with corresponding heat exchanger plates 12, 14 to form a U-flow or two-pass heat exchanger. In this embodiment, frame member 616 is a unitary structure comprised of a length of frame material having two fee ends 641 that is bent or formed into the desired configuration. Accordingly, frame member 616 has first and second ends 640(1), 640(2) in the form of the second or manifold sealing member 634. The first and second ends 640(1), 640(2) form fluid boundaries or barriers around two adjacent openings (i.e. openings 20, 22 or 24, 26) formed in the corresponding plates 12, 14 and terminate at end edges or free ends 641which form an overlapping or lap joint with the interior edge or surface of a corresponding portion of the first sealing member 632. The remaining portion of the frame member 616 generally follows or corresponds to the periphery of the plates 12, 14 in order to form first sealing member 632 around the edge of the plates 12, 14.

A flow separating region 656 is formed integrally within frame member 616 in order to accommodate for the U-shaped or two-pass fluid path through the fluid channel members 10 forming the heat exchanger. Flow separating region 656 is formed by bending the frame material along the end edge 35 opposite to the second or manifold sealing members 640 to form a narrow, elongated fluid barrier that projects into the interior region of the frame member 616. The flow separating region 656 causes the fluid entering the fluid channel member 10 to flow from the inlet opening (for example opening 20) along the length of the fluid passageway 18 formed by fluid channel member 10 in a first direction before turning or reversing directions around the end 657 of the flow separating region 656 and flowing along the length of the fluid channel member 10 in a second direction over the second half of the plates 12, 14 to the outlet opening. The second fluid flowing through the heat exchanger is prevented from entering the fluid flow passageway 18 by the second or manifold sealing members 634 and instead enters the fluid flow passageway formed by the adjacent fluid channel member 10. It will be understood that the frame members 616 in adjacent fluid channel members are rotated 180 degrees with respect to each other in order to create the alternating fluid flow passageways 18(1), 18(2) for the flow of two different fluids through the heat exchanger 100.

Figure 18:
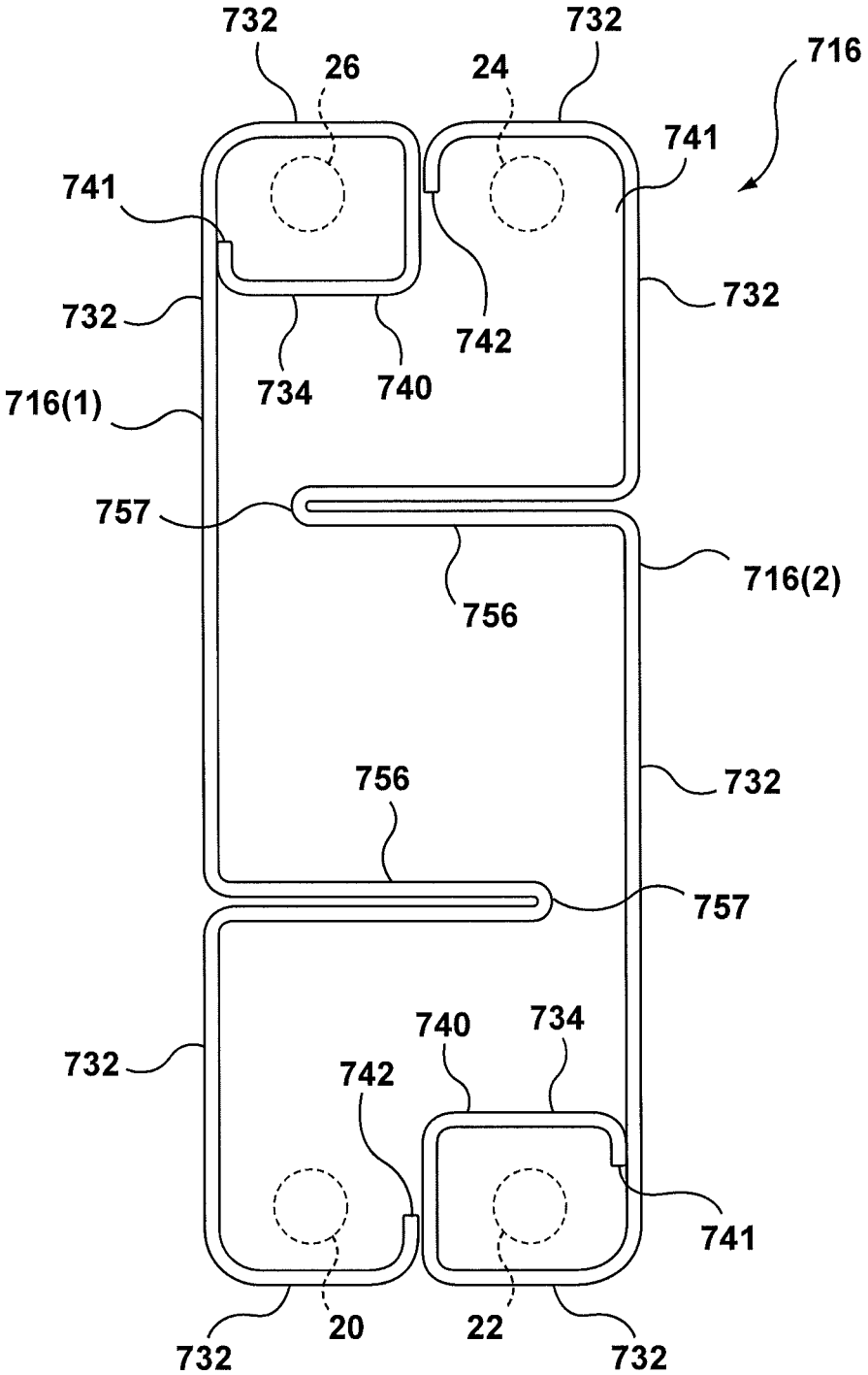
FIG. 18 is a top view of a frame member according to another exemplary embodiment of the present disclosure for forming a multi-pass fluid channel.

Referring now to FIG. 18 there is shown a frame member 716 according to another example embodiment of the present disclosure that is adapted to create multi-pass fluid channel members 10 when combined with corresponding heat exchanger plates 12, 14 in a stacked, alternating relationship to form heat exchanger 100. In this embodiment, frame member 716 is comprised of first and second frame portions 716(1), 716(2) that are each formed by a length of material having two free ends that is bent into the desired configuration. The first and second frame portions 716(1), 716(2) are generally identical to each other, with the second frame portion 716(2) being rotated 180 degrees with respect to the first portion 716(1), or vice versa. Each of the first and second fame portions 716(1), 716(2) has a first end 740 in the form of second sealing member 734 while the remainder of the frame portion 716(1), 716(2) generally follows the periphery of the corresponding heat exchange plates 12, 14, i.e. along a portion of one of the end edges 37 of the plate, along one of the longitudinal edges 35, and a portion of the other of the end edges 35 before terminating at a second end 742 in the form of a free end.

The first end 740 or second sealing member 734 of each frame portion 716(1), 716(2) forms a fluid boundary or barrier around one of the fluid openings (i.e. one of openings 20, 22 or 24, 26) of a corresponding pair of openings formed in the corresponding plates 12, 14, the first end 740 of the frame portions 716(1), 716(2) terminating at an end edge 741 in the form of a free end that forms an overlapping or lap joint with the interior edge or surface of a corresponding portion of the first sealing member 732.

At least one flow separating region 756 is formed integrally within each frame portion 716(1), 716(2) in order to create a multi-pass fluid flow passageway through the fluid channel members 10 formed by heat exchange plates 12, 14 and frame member 716. Flow separating region 756 is formed by creating a narrow, elongated, tight-radius bend in the material forming frame portions 716(1), 716(2) along the longitudinal edge of the first sealing member 732 intermediate the first end 740 and second end 742, although more proximal to the second end 742, as shown in the example embodiment of FIG. 18. The flow separating region 756, therefore, extends into the interior region of the fluid channel member 10 bounded by frame member 716 in a direction generally perpendicular to the main, overall flow direction through the fluid channel member 10, for example from inlet opening 22 through to diagonally opposed outlet opening 24.

When the first and second frame portions 716(1), 716(2) are brought together into their mating relationship in order to form frame member 716, the free end at the second end 742 of one frame portion 716(1), 716(2) abuts against a corresponding portion of the first end 740 or second sealing member 734 of the other of the frame portions 716(1), 716(2) thereby forming the first sealing member 734 around the entire periphery of the corresponding plates 12, 14. The flow separating regions 756 from each frame portion 716(1), 716(2) extend into the area bounded by the first sealing member 734 from opposite longitudinal sides of the frame member 716 in spaced apart relation to each other. Accordingly, the flow separating regions 756 effectively forming baffles within the fluid flow passageway 18 formed within fluid channel member 10 causing the fluid to make a series of switch-back or hair-pin turns around the respective ends 757 of the flow separating regions 756 through the fluid flow passageway 18 from the inlet opening (for example inlet opening 22) before exiting the fluid channel member 10 through the corresponding outlet opening (for example outlet opening 24). The second fluid flowing through the heat exchanger is prevented from entering the fluid flow passageway 18 by the second or manifold sealing members 734 and instead enters the fluid flow passageway 18 formed by the adjacent fluid channel member 10 and, in the subject example embodiment, flows in a direction generally opposite to the first fluid flowing through the heat exchanger 100. In the subject embodiment, it will be understood that the combined frame members 716 (i.e. frame portions 716(1), 716(2) arranged in their mating relationship) in adjacent fluid channel members 10 are rotated 180 degrees with respect to each other in order to create the alternating fluid flow passageways 18(1), 18(2) for the flow of two different fluids through the heat exchanger 100.

While the embodiment shown in FIG. 18 shows frame portions 716(1), 716(2) each being formed with one flow separating region 756 it will be understood that each frame portion 716(1), 716(2) can be formed with as many flow separating regions 756 as is required in order to achieve the desired flow path through the fluid channel members 10. Accordingly, the embodiment shown in FIG. 18 is intended to be illustrative and not limited thereto.

Figure 19:
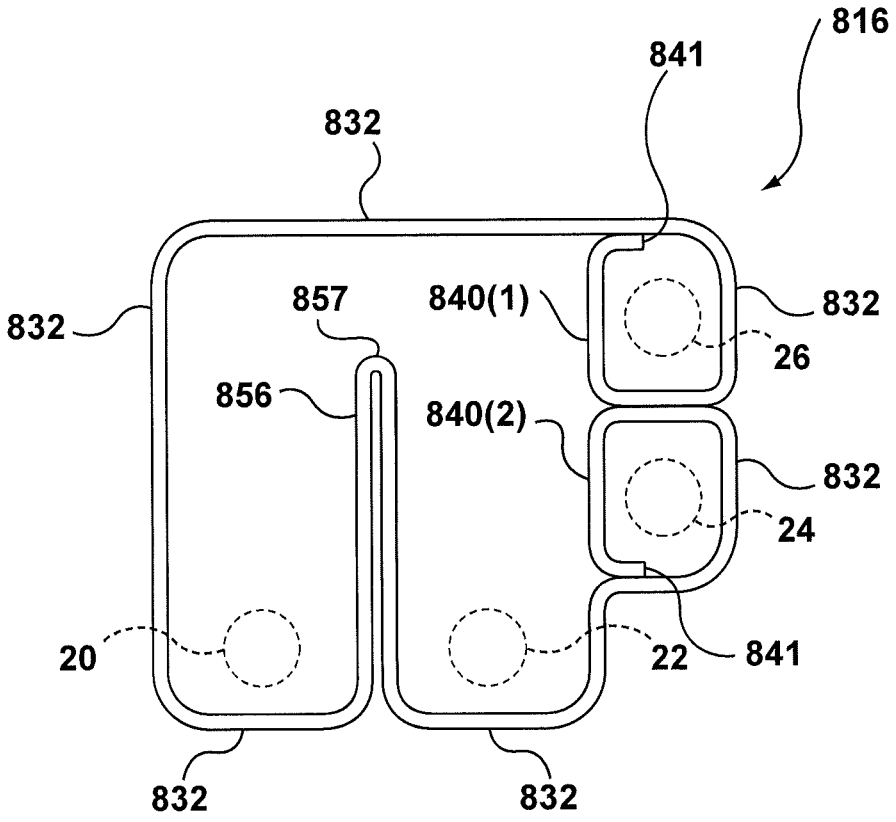
FIG. 19 is a top view of a frame member according to another exemplary embodiment of the present disclosure for forming fluid channels for a cross-flow heat exchanger wherein the respective inlet and outlet manifolds are arranged at 90 degrees with respect to each other.

Referring now to FIG. 19 there is shown a frame member 816 according to another example embodiment of the present disclosure that is adapted to create stackable fluid channel members 10 with corresponding heat exchanger plates 12, 14 to form a U-flow or two-pass cross-flow heat exchanger where the corresponding pairs of inlet and outlet manifolds are arranged at 90 degrees with respect to each other as shown in the drawing. In this embodiment, frame member 816 is a unitary structure comprised of a length of frame material, having two free ends 841 that is bent or formed into the desired configuration. Accordingly, frame member 816 has a pair of first ends 840(1), 840(2) in the form of the second or manifold sealing member 834. The pair of first ends 840(1), 840(2) each forming a fluid boundary or barrier around adjacent openings (i.e. openings 20, 22 or 24, 26) formed in the corresponding heat exchange plates 12, 14. Each of the first ends 840(1), 840(2) terminate at end edges or free ends 841and form an overlapping or lap joint with the interior edge or surface of a corresponding portion of the first sealing member 832 to provide a complete seal around the corresponding fluid opening. The remaining portion of the frame member 816 generally follows or corresponds to the periphery of the plates 12, 14 in order to form the first sealing member 832 around the edge of the plates 12, 14 when the frame member 816 is sandwiched between corresponding heat exchange plates 12, 14.

In order to create the desired two-pass or U-flow fluid passageway through the fluid channel members 10, frame member 816 also comprises a flow separating region 856 that is formed integrally within frame member 816 in order to accommodate for the U-shaped or two-pass fluid path through the fluid channel members 10 forming the heat exchanger. Flow separating region 856 is formed by bending the frame material to form a narrow, elongated fluid barrier between two adjacent fluid openings, the fluid barrier projecting into the interior region of the frame member 816. The flow separating region 856 causes the fluid entering the fluid channel member 10 to flow from the inlet opening (for example opening 20) along the length of the fluid passageway 18 formed by fluid channel member 10 in a first direction before turning or reversing directions around the end 857 of the flow separating region 856 and flowing along the length of the fluid channel member 10 in a second, opposite direction over the second half of the plates 12, 14 to the outlet opening 22. The second fluid flowing through the heat exchanger is prevented from entering the fluid flow passageway 18 by the second or manifold sealing members 834 and instead enters the fluid flow passageway formed by the adjacent fluid channel member 10.

It will be understood that in order to create a cross-flow pattern through the heat exchanger where the first fluid flowing through the heat exchanger flows in a direction generally perpendicular to the direction of the second fluid flowing through the heat exchanger, the frame members 816 in adjacent fluid channel members 10 are inverted or flipped and rotated 90 degrees with respect to each other in order to create the alternating cross-flow fluid flow passageways for the flow of two different fluids through the heat exchanger 100. It will also be understood that the heat exchange plates 12, 14 forming the fluid channel members 10 with frame members 816 will not be generally rectangular in shape since one of the pairs of manifolds (i.e. fluid openings 24, 26 shown in FIG. 19) are located outboard of the general fluid flow passageway.

Figure 20:
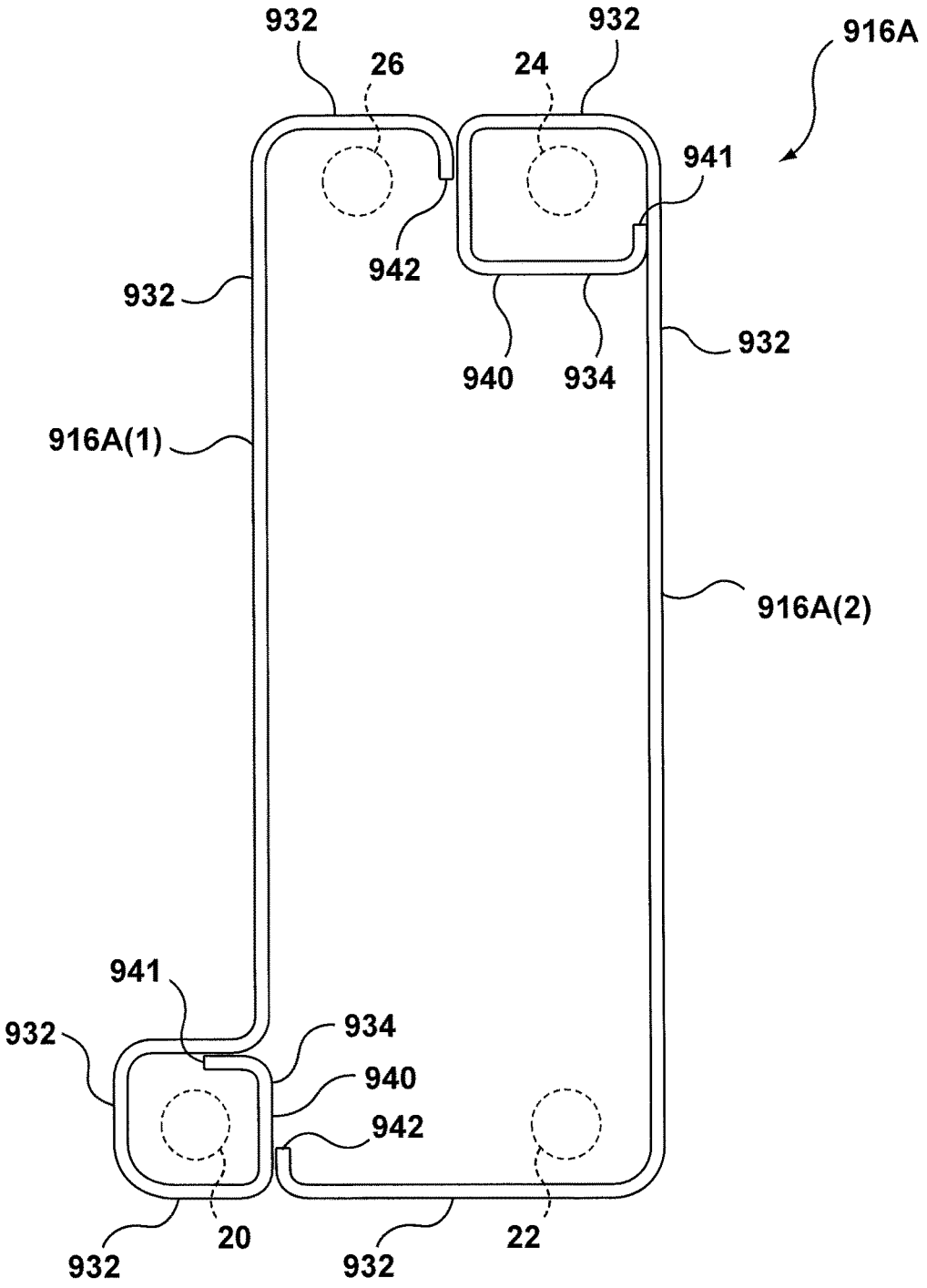
FIG. 20 is a top view of a first frame member according to another exemplary embodiment of the present disclosure for forming a heat exchanger with an outboard fluid port.
Figure 21:
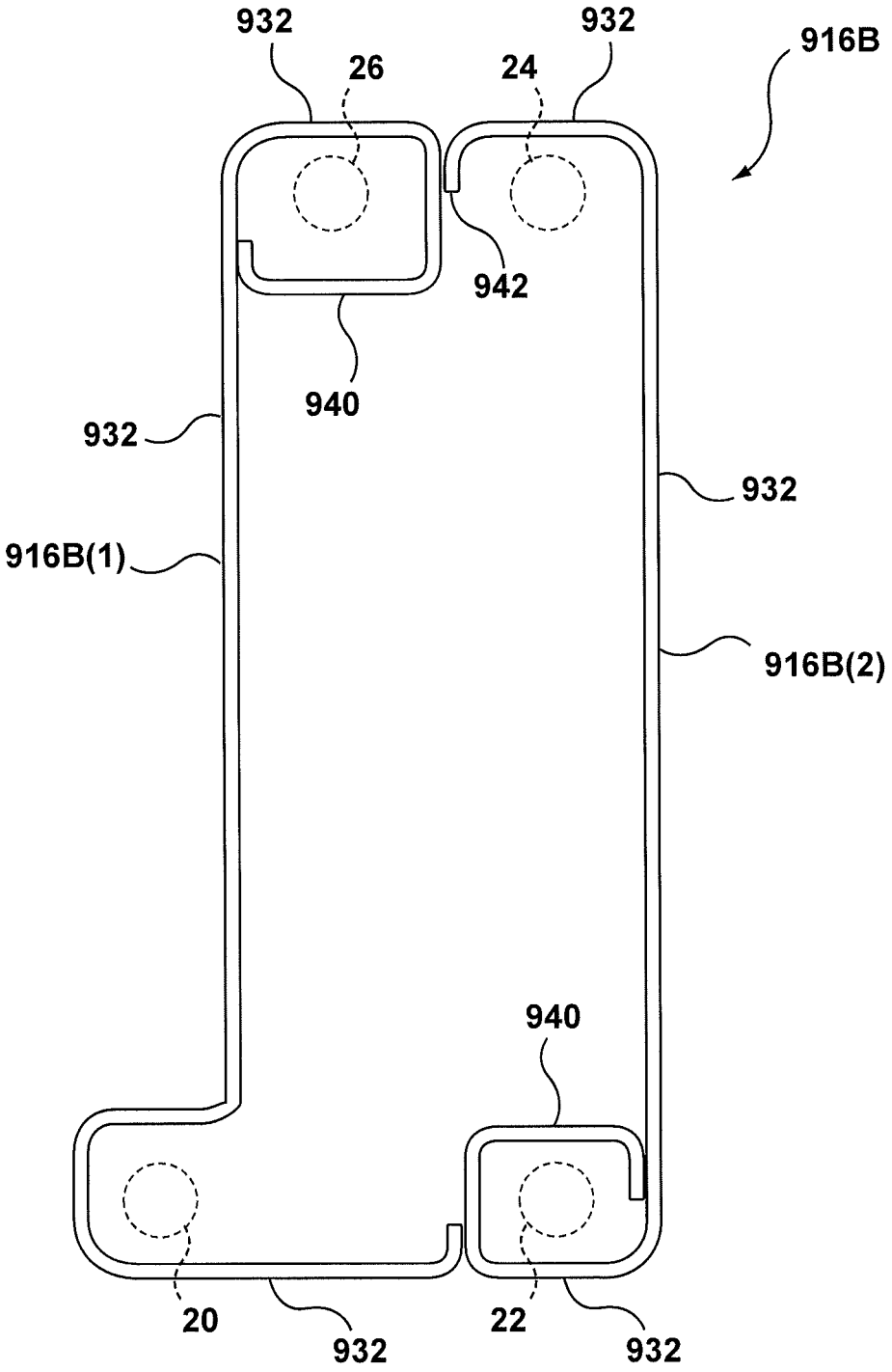
FIG. 21 is a top view of a second frame member used in conjunction with the first frame member shown in FIG. 20 to form the heat exchanger with an outboard fluid port.

Referring now to FIGS. 20 and 21, there is shown another example embodiment of frame members 916A, 916B used in conjunction with corresponding heat exchange plates 12, 14 for forming a stacked plate heat exchanger 100 with an outboard fluid port.

In the subject embodiment, the heat exchanger 100 is comprised of a stack of fluid channel members 10 comprising a pair of first and second plates 12, 14 that are spaced apart from one another and connected together by one of two different frame members 916A, 916B so as to form an alternating stack of fluid passageways 18(1), 18(2) therebetween. As in the previously described embodiments, a turbulizer or other heat transfer augmenting device (not shown) may be positioned within fluid passageways 18(1), 18(2) in the interior region defined by either of frame members 916A, 916B between plates 12, 14 depending upon the particular design and application of heat exchanger 100.

The plates 12, 14 that would form fluid channel members 10 with frame members 916A, 916B are generally flat plates with a modified rectangular shape having an outboard area for accommodating a fluid inlet/outlet opening for the flow of one of the fluid through the heat exchanger. The plates 12, 14 therefore are each provided with four openings 20, 22, 24, 26 with three of the openings 22, 24, 26 being positioned at three respective corners of the plates 12, 14 with the fourth fluid opening 20 being located in the outboard area of the plate. As in the previously described embodiments, the openings 20, 22, 24, 26 serve as respective inlet/outlet ports for the inletting and discharging of a fluid into their corresponding fluid passageway 18. When a plurality of fluid channel members 10 are arranged one on top of the other, the openings 20, 22, 24, 26 align with the corresponding openings 20, 22, 24, 26 in the adjacent fluid channel member 10 to form respective pairs of inlet/outlet manifolds (not shown) for two separate fluids to flow through the heat exchanger 100 as is known in the art with one of the manifolds from one of the pairs of manifolds being located in the outboard area of the heat exchanger.

In order to create the alternating fluid flow passageways 18(1), 18(2) through the heat exchanger for the two different fluids, two different frame members 916A, 916B are required. Frame member 916A is comprised of mating first and second frame portions 916A(1), 916A(2) that are different to each other. Each of the first and second fame portions 916A(1), 916A(2) has a first end 940 in the form of a portion of the second sealing member 934 while the remainder of the frame portion 916A(1), 916A(2) follows the periphery of the corresponding heat exchanger plates 12, 14 along the remainder of a longitudinal edge portion 35 and at least a portion of each of the end edge portions 37 of the plates forming a portion of the first sealing member 932 before each frame portion 916A(1), 916A(2) terminates at a second, free end 942.

Each of the first ends 940 of frame portions 916A(1), 916A(2) forms a fluid boundary around a corresponding fluid opening before terminating at an end edge or free end 941and forming an overlapping or lap joint with the interior edge or surface of a corresponding portion of the first sealing member 932 of the same frame portion 916A(1), 916A(2) to provide a complete seal around the corresponding fluid opening. Each of the second ends 942 of each of frame portions 916A(1), 916A(2) abuts a corresponding portion of the first end 940 of the corresponding frame portion 916A (1), 916A(2) forming corresponding butt joints when the frame portions 916A(1), 916A(2) are brought into their mating relationship forming frame member 916 and completing the first sealing member 932. Accordingly, a first series of fluid channel members 10A for forming the heat exchanger are formed by arranging frame member 916A between a pair of corresponding plates, the first series of fluid channel members 10A permitting a first fluid to enter the fluid passageway bounded by frame member 916A through one of openings 22, 26 and exit through the other of the openings 22, 26 while the second fluid flowing through the heat exchanger is prevented from entering the fluid passageway bounded by frame member 916A by means of the second sealing member 934 formed around the remaining two fluid openings formed in the plates.

Frame member 916B (see FIG. 21) is also comprised of mating first and second frame portions 916B(1), 916B(2) that are different to each other and different to frame portions 916A(1), 916A(2). Frame portions 916B(1), 916B(2) each have a first end 940 in the form of a portion of the second sealing member 934 while the remainder of the frame portion 916B(1), 916B(2) follows a portion of the periphery of the corresponding heat exchanger plates 12, 14 before terminating at a second, free end 942. Each of the first ends 940 of frame portions 916B(1), 916B(2) forms a fluid boundary around the opposite pair of corresponding fluid openings (i.e. openings 22, 26), the first ends 940 terminating at an end edge or free end 941that forms an overlapping or lap joint with an interior edge or surface of a corresponding portion of the first sealing member 932 of the same frame portion 916B(1), 916B(2) to provide a complete seal around the corresponding fluid opening (i.e. openings 22, 26). Each of the second ends 942 of each of frame portions 916B(1), 916B(2) abuts a corresponding portion of the first end 940 of the corresponding frame portion 916B(1), 916B (2), forming corresponding butt or overlap joints, when the frame portions 916A(1), 916A(2) are brought into their mating relationship forming frame member 916B and completing the first sealing member 932. Accordingly, a second series of fluid channel members 10B for forming the heat exchanger are formed by arranging frame member 916B between a pair of corresponding heat exchange plates, the second series of fluid channel members 10B permitting the second heat exchange fluid to enter the fluid passageway bounded by frame member 916B through one of openings 20, 24 and exit through the other of the openings 20, 24 while the first fluid flowing through the heat exchanger is prevented from entering the fluid passageway bounded by frame member 916B by means of the second sealing member 934 formed around the remaining two fluid openings (i.e. fluid openings 22, 26) formed in the plates.

Accordingly, it will be understood that the heat exchanger formed with frame members 916A, 916B is comprised of an alternating stack of the first series fluid channel members 10A and the second series fluid channel members 10B, i.e. an alternating stack of heat exchange plate, frame member 916A, heat exchange plate, frame member 916B, etc.

As in the previously described embodiments, frame members 916A, 916B are also formed from lengths of material that are bent or formed into the desired configuration, the frame portions for each of frame members 916A, 916B being brought into a mating relationship to complete the first sealing member 934 and thereby provide a complete, fluid-tight seal around the periphery of the heat exchange plates when all of the components are brazed, or otherwise joined together.

While heat exchanger 100 has been described as being formed by an alternating stack of generally flat plates 12, 14 interposed with frame members 16, variations to the plates 12, 14 are also contemplated within the scope of the present disclosure.

Figure 11:
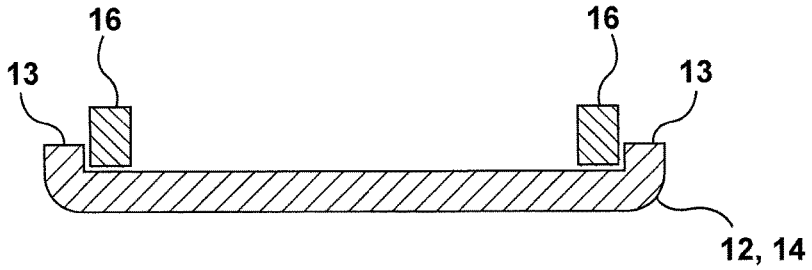
FIG. 11 is a detail cross-sectional view of a portion of a heat exchanger according to another example embodiment of the present disclosure.

Referring now to FIG. 11, an alternate embodiment of the plates 12, 14 used to form fluid channel members 10 is shown. As shown, the plates 12, 14 may be formed with a slight lip or edge 13 around the perimeter of the plate 12, 14, the plate 12, 14 thereby adopting a slight dished-plate formation. By forming a slight lip 13 around the perimeter of the plate 12, 14, the frame member 16 can sit within the dished-edge to ensure that the frame member 16 is appropriately positioned around the perimeter of the plate 12, 14.

Figure 12:
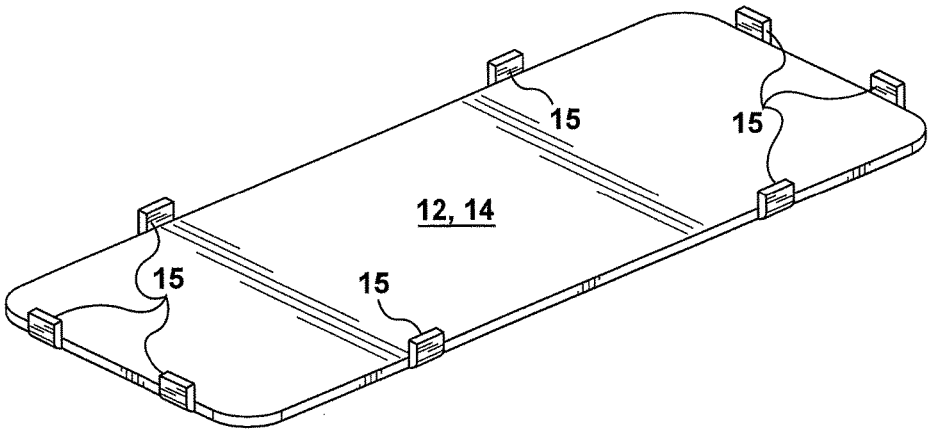
FIG. 12 is a top perspective view of a heat exchanger plate according to another example embodiment of the present disclosure.
Figure 12A:
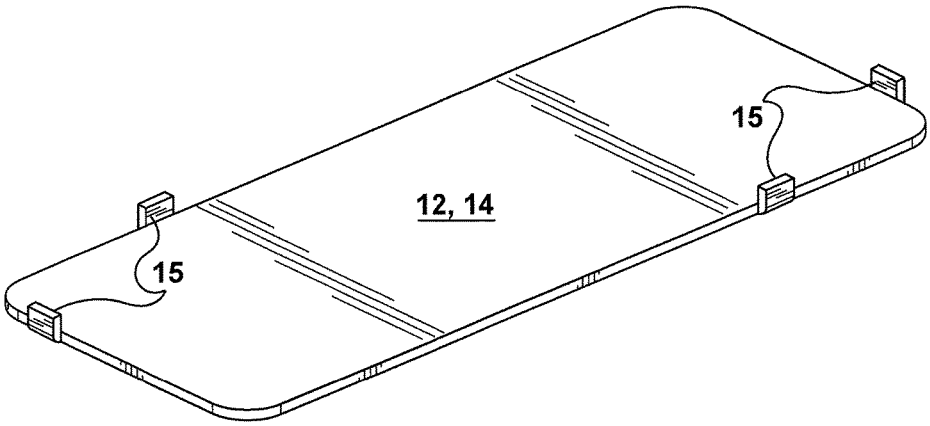
FIG. 12A is top perspective view of a variation of the heat exchanger plate shown in FIG. 12.

Referring now to FIG. 12 there is shown another example embodiment of a plate 12, 14 that can be used to form heat exchanger 100. In this embodiment, rather than forming plates 12, 14 as "dished-plates" with a lip or edge 13 around the entire perimeter of the plates 12, 14, the plates 12, 14 can instead be formed with locating or fixturing tabs 15 positioned at specific locations around the perimeter of the plates 12, 14. Fixturing tabs 15 provide an interior edge against which the frame members 16 can abut when stacked on top of the plate 12, 14. In some embodiments, the fixturing tabs 15 can also be folded over the upper edge of the frame member 16 once it is positioned on top of the plate 12, 14 to ensure that the frame member 16 is securely positioned thereon when forming fluid channel members 10. For example with reference to the example embodiment shown in FIG. 7, a plate 12, 14 with as few as two fixturing tabs 15 corresponding to the frame overlap locations 256 could be sufficient to hold and lock the overlapping frame member 216(1), 216(2) to its corresponding faying frame member 216(1), 216(2) in association with one of the plates 12, 14 to form a "locked" subassembly comprising a plate 12, 14 with frame member 216 positioned thereon. Such "locked" subassemblies may then be stacked together for joining in a brazing furnace to form heat exchanger 100. An example of a heat exchange plate 12, 14 with two fixturing tabs 15 formed only at the corners of the plate corresponding to the frame overlap locations (i.e. the stepped connection 256) is shown in FIG. 12A.

The method of making a heat exchanger 100 comprising plates 12, 14 and frame members 16, 116, 216, 316, 416, 516, 616 is to begin with a plurality of flat heat transfer plates 12, 14 that have been stamped or cut to the desired shape and size with appropriate fluid openings 20, 22, 24, 26 formed therein. Fluid openings 20, 22, 24, 26 can also be stamped or cut into the plates 12, 14. The next step is to provide a plurality of frame members 16 by forming lengths of material such as lengths of wire, rods or bars that are bent into the desired frame shape depending upon the particular application or design of the heat exchanger 100. Where lengths of wire material are used, a wire feed machine or CNC formed wire can be used to fabricate repeating patterns of the individual, mating frame portions 16(1), 16(2) with the wire material being bent into the desired form and in some instances interlocking members are formed in the wire material to provide for a mechanical connection between the individual frame portions 16(1), 16(2). In other instances, instead of using a wire feed machine, the frame members can be formed by bending the wire material free-form around a mandrel or jig. Whether a wire feed or CNC machine is used to fabricate the frame portions 16(1), 16(2) may depend of the type of interlocking connection that is incorporated into the frame portions 16(1), 16(2). For instance, the overlapping or stepped connections 356, 256 are more conducive to be free formed as opposed to the dovetail or jigsaw connections.

In instances where wire material having a square cross-sectional shape is used, the formed wire frame portions may then be subjected to a post-bending flattening operation such as coining or spanking in order to flatten out any deformations in the material that result from the bending of the square-shaped wire material since the square-shaped wire material tends to deform in the vertical direction at the corner areas formed in the frame 16. The flattening operation may also serve to ensure locking or securing together of the frame members at their respective joints. When round or oval wire frame material is used to form the frame members 16, post-bending flattening operations may not be required since the round or oval wire frame material does not tend to deform as much in the vertical direction when bent to form corners as in the case of the square-shaped wire frame material. However, round or oval shaped wire material, rods or bars may be subjected to post-bending flattening operations, if desired, especially if additional locking or securing together of the frame members is required.

In embodiments where the frame members 16 are formed by two mating frame portions 16(1), 16(2), once the plurality of individual frame portions 16(1), 16(2) are formed, the frame portions 16(1), 16(2) are positioned together in their mating relationship by interconnection of the dovetail or jigsaw connections, or by means of the overlapping or stepped connections, to form frame members 16. Fluid channel members 10 are then formed by arranging the plates 12, 14 and frame members 16 in their alternating, stacked relationship with the frame members 16 in the first set of fluid flow passages 18(1) being rotated 180 degress with respect to the frame members 16 in the second set of fluid flow passages 18(2). Preferably, each fluid channel 10 will contain within the boundaries of the frame members 16 a suitable heat transfer augmentation device such as a turbulizer or fin (not shown) as is known in the art. Once the stack of fluid channel members 10 is formed, end plates to seal the outermost fluid channel members 10 in the stack are added, the entire assembly being joined together by brazing to form heat exchanger 100.

It will be appreciated that although the frame members 16, 116, 216, 316, 416, 516 may be joined together entirely by mechanical means such as interlocking members as described, additional assembly aids such as tack welding may be used if needed, to secure butt joints, for example. Tack welding may also be used to secure butt joints found in one piece frame members 616.

In instances where dished plates or tabbed plates, such as those shown in FIGS. 11 and 12 are used, various subassemblies comprising one plate 12, 14 and one frame member 16, 116, 216, 316, 416, 516 (i.e. as shown in FIG. 11) are formed, the various subassemblies then being stacked one on top of the other and joined together by brazing to form heat exchanger 100, with appropriate end plates (not shown) and fluid inlet/outlet connections as is know in the art.

While various exemplary embodiments of the heat exchanger with a jointed wire frame have been described and shown in the drawings, it will be understood that certain adaptations and modifications of the described exemplary embodiments can be made as construed within the scope of the present disclosure. Therefore, the above discussed embodiments are considered to be illustrative and not restrictive.

What is claimed is:

1. A heat exchanger comprising:

a plurality of stacked heat exchanger plates;

a plurality of frame members, wherein one frame member of the plurality of frame members is interposed between adjacent ones of the plurality of stacked heat exchanger plates such that the one frame member interposed between adjacent heat exchanger plates, spaces apart the adjacent heat exchanger plates, the plurality of frame members and the plurality of stacked heat exchanger plates together defining fluid channels therebetween;

corresponding pairs of openings formed in each of said heat exchanger plates, the corresponding pairs of openings in adjacent plates aligning so as to define respective inlet and outlet manifolds for inletting and discharging a first and a second fluid through corresponding ones of said fluid channels in said heat exchanger;

wherein each heat exchanger plate defines a perimeter, and each one of said plurality of frame members comprises:

a first frame portion; and a second frame portion;

wherein the first frame portion and the second frame portion are identical, separate, unitary members disposed in mating relationship such that one of the first frame portion and the second frame portion is rotated 180 degrees with respect to the other one of the first frame portion and the second frame portion about an axis perpendicular to a longitudinal axis of the one frame member of the plurality of frame members, the first frame portion and the second frame portion being cooperatively configured and disposed between adjacent heat exchanger plates such that the mating of the first and second frame portions is with effect that a first sealing member is disposed about the perimeter of each heat exchanger plate for sealingly joining the adjacent heat exchanger plates together at their perimeters defining the fluid channels therebetween, and a second sealing member is disposed within the perimeter of the heat exchanger plate fluidly isolating each opening in one of the corresponding pairs of openings from the fluid channel defined by the first sealing member and the heat exchanger plates, the other pair of corresponding openings remaining in fluid communication with the fluid channel; and wherein:

the first frame portion and the second frame portion are each defined by a length of material selected from the group consisting of: wire, rod and bar, the length of material being bent to form a portion of the first sealing member and a portion of the second sealing member such that each first frame portion and each second frame portion has two free ends forming two separate joints;

the length of material has a substantially constant cross-sectional shape, such that a cross-sectional shape of an entirety of the first and second sealing members and a cross-sectional shape of an entirety of the first frame portion and the second frame portion, is constant throughout; and the mating disposition of the first frame portion and the second frame portion is with effect that a pair of first joints is disposed in the first sealing member such that a first joint is disposed between the first frame portion and the second frame portion at each junction of the first frame portion and the second frame portion, each one of the plurality of frame members further defining a pair of second joints, such that a second joint is disposed at respective junctions between the second sealing member and the first sealing member.

2. The heat exchanger as claimed in claim 1, wherein each of said first and second frame portions comprises a portion of said first sealing member and a first end in the form of a portion of said second sealing member.

3. The heat exchanger as claimed in claim 1, wherein each of said first and second frame portions comprises a male interlocking member and a female interlocking member, the male interlocking member on one frame portion being received in the corresponding female interlocking member on the other frame portion forming one of said joints.

4. The heat exchanger as claimed in claim 3, wherein said male and female interlocking members are selected from one of the following alternatives: a stepped connection wherein the male interlocking member is an end section of a frame portion and the female interlocking member is a stepped recess formed in said first sealing member, a dovetail connection wherein the male interlocking member is a dovetail projection and wherein the female interlocking member is a recess adapted to receive said dovetail projection, a jigsaw connection wherein the male interlocking member and female interlocking member are in the form of corresponding jigsaw components, and a pocket connection wherein the male interlocking member is an end section of a frame portion and the female interlocking member is a pocket recess formed in said first sealing member.

5. The heat exchanger as claimed in claim 1, wherein said first frame portion and said second frame portion is a CNC fabricated wire frame member, said wire frame member being one of: square wire frame material, rectangular wire frame, round wire frame material, or oval wire frame material that is bent to form said frame member.

6. The heat exchanger as claimed in claim 1, wherein each first frame portion and each second frame portion further comprises a flow separating region extending into an interior region of said fluid channel, said flow separating regions extending generally perpendicular to a principle fluid flow direction through said fluid channels, said flow separating regions extending in opposite directions and being longitudinally spaced apart from each other thereby forming a multi-pass fluid flow passageway between a corresponding pair of inlet and outlet openings.

7. The heat exchanger as claimed in claim 1, wherein said heat exchanger plates are dish-style heat exchanger plates having a lip formed around the periphery of each of the plates.

8. The heat exchanger as claimed in claim 1, wherein said heat exchanger plates have fixturing tabs formed at spaced apart intervals around the periphery of each of the plates, said fixturing tabs are adapted to engage the frame member positioned on respective ones of said plurality of heat exchanger plates.

9. The heat exchanger as claimed in claim 1, wherein said frame member has an outer periphery defining a generally uniform edge.

10. The heat exchanger as claimed in claim 1, wherein the length of material comprises:

a rectangular bar or wire having two opposed short sides and two opposed long sides, wherein the two opposed shorter sides are in contact with the heat exchanger plates and the heat exchanger plates are spaced apart by the long sides of the rectangular bar or wire.

* * * * *